US009411296B2

(12) United States Patent
Ikeda

(10) Patent No.: US 9,411,296 B2
(45) Date of Patent: Aug. 9, 2016

(54) END PORTION MEMBER, PHOTOSENSITIVE DRUM UNIT AND PROCESS CARTRIDGE

(71) Applicant: Mitsubishi Chemical Corporation, Tokyo (JP)

(72) Inventor: Shuichi Ikeda, Kanagawa (JP)

(73) Assignee: MITSUBISHI CHEMICAL CORPORATION, Tokyo (JP)

( * ) Notice: Subject to any disclaimer, the term of this patent is extended or adjusted under 35 U.S.C. 154(b) by 0 days.

(21) Appl. No.: 14/792,135

(22) Filed: Jul. 6, 2015

(65) Prior Publication Data

US 2015/0309466 A1 Oct. 29, 2015

Related U.S. Application Data

(62) Division of application No. 13/963,099, filed on Aug. 9, 2013.

(30) Foreign Application Priority Data

| | | |
|---|---|---|
| Aug. 10, 2012 | (JP) | 2012-178349 |
| Aug. 29, 2012 | (JP) | 2012-189071 |
| May 21, 2013 | (JP) | 2013-107280 |
| Jun. 24, 2013 | (JP) | 2013-131845 |

(51) Int. Cl.
*G03G 15/00* (2006.01)
*G03G 21/18* (2006.01)

(52) U.S. Cl.
CPC ..... *G03G 15/751* (2013.01); *G03G 15/757* (2013.01); *G03G 21/186* (2013.01)

(58) Field of Classification Search
None
See application file for complete search history.

(56) References Cited

U.S. PATENT DOCUMENTS

| | | | |
|---|---|---|---|
| 2,634,991 | A | 4/1953 | Stevens |
| 5,903,803 | A | 5/1999 | Kawai et al. |
| 5,987,287 | A | 11/1999 | Huang |
| 6,006,058 | A | 12/1999 | Watanabe et al. |
| 6,029,032 | A | 2/2000 | Watanabe et al. |
| 6,169,866 | B1 | 1/2001 | Watanabe et al. |
| 6,175,706 | B1 | 1/2001 | Watanabe et al. |
| 6,226,478 | B1 | 5/2001 | Watanabe et al. |

(Continued)

FOREIGN PATENT DOCUMENTS

| | | |
|---|---|---|
| JP | 8-328449 | 12/1996 |
| JP | 10-153941 | 6/1998 |

*Primary Examiner* — David Gray
*Assistant Examiner* — Geoffrey Evans
(74) *Attorney, Agent, or Firm* — Oblon, McClelland, Maier & Neustadt, L.L.P

(57) ABSTRACT

A bearing member engageable and disengageable from a recessed portion of an image forming apparatus body is included. While the bearing member is engaged into the recessed portion, a cross-sectional area occupancy ratio which is a degree of area occupied by a cross-section of the bearing member to a cross-section of the recessed portion is 15% or higher and 75% or less. An outer peripheral shape of the bearing member in a cross-section is a hexagon, and assuming that a radius of a circumscribed circle of the hexagon is $r_{1g}$, and when a hexagon is formed by sides enclosed by a triangle formed at an opening of the recessed portion when the recessed portion is viewed from a front in the axial direction and a triangle formed at a bottom of the recessed portion, a radius of an inscribed circle of the hexagon is $r_{2h}$, $r_{1g}-r_{2h}>0$.

11 Claims, 26 Drawing Sheets

(56) References Cited

U.S. PATENT DOCUMENTS

| | | | |
|---|---|---|---|
| 6,240,266 | B1 | 5/2001 | Watanabe et al. |
| 6,324,363 | B1 | 11/2001 | Watanabe et al. |
| 6,400,914 | B1 | 6/2002 | Noda et al. |
| 7,813,676 | B2 | 10/2010 | Huck et al. |
| 8,737,882 | B2 | 5/2014 | Peng et al. |
| 8,953,984 | B2 | 2/2015 | Iijima et al. |
| 9,031,459 | B2 | 5/2015 | Ikeda et al. |
| 9,182,741 | B2 * | 11/2015 | Ikeda ..... G03G 21/186 |
| 2008/0145091 | A1 | 6/2008 | Hwang |
| 2010/0303501 | A1 | 12/2010 | Tsui |
| 2013/0251405 | A1 | 9/2013 | Iijima et al. |
| 2013/0252793 | A1 | 9/2013 | Iijima et al. |
| 2013/0287488 | A1 | 10/2013 | Iijima |
| 2014/0072342 | A1 | 3/2014 | Iijima et al. |
| 2014/0341612 | A1 | 11/2014 | Ikeda et al. |
| 2016/0062300 | A1 * | 3/2016 | Takagi ..... F16D 1/10 464/157 |

* cited by examiner

END PORTION MEMBER, PHOTOSENSITIVE DRUM UNIT AND PROCESS CARTRIDGE

CROSS-REFERENCE TO RELATED APPLICATIONS

This application is a division of U.S. application Ser. No. 13/963,099 filed Aug. 9, 2013, the entire contents of which is incorporated herein by reference. U.S. application Ser. No. 13/963,099 is based upon and claims the benefit of priority to prior Japanese Patent Application Nos. 2012-178349, 2012-189071, 2013-107280 and 2013-131845 filed Aug. 10, 2012, Aug. 29, 2012, May 21, 2013 and Jun. 24, 2013, respectively.

TECHNICAL FIELD

The present invention relates to a process cartridge attached to an image forming apparatus such as a laser printer or a copying machine, a photosensitive drum unit mounted to the process cartridge, and an end portion member included in the photosensitive drum unit.

BACKGROUND ART

An image forming apparatus such as a laser printer or a copying machine is provided with a process cartridge that is attachable to and detachable from a body of the image forming apparatus (hereinafter, may be referred to as an "apparatus body").

The process cartridge is a member that forms contents to be displayed, such as text or figures, in an attitude of being mounted to the apparatus body and transfers the contents onto a recording medium such as paper. Therefore, the process cartridge includes a photosensitive drum on which the contents to be transferred are formed and charging means and developing means for forming the contents to be transferred on the photosensitive drum.

Regarding the process cartridge, for maintenance, the same type of process cartridge is attached to or detached from the apparatus body, or an old process cartridge is separated from the apparatus body to be replaced with a new process cartridge and then the new process cartridge is mounted to the apparatus body. Attachment and detachment of the process cartridge can be performed by a user of the image forming apparatus themself, and from this point of view, it is preferable that attachment and detachment be performed as easy as possible.

The photosensitive drum included in the process cartridge needs to be rotated during operation. The photosensitive drum is provided with an end portion member (bearing member) to which a driving shaft of the apparatus body is engaged directly or via another member such that the photosensitive drum is rotated by receiving a rotational force from the driving shaft.

On the other hand, in order to attach and detach the process cartridge to and from the apparatus body, the engagement between the driving shaft of the apparatus body and the bearing member provided in the photosensitive drum needs to be released (separated) or re-engagement therebetween is needed on each occasion.

In Patent Documents 1 and 2, there are techniques disclosed in which the driving shaft that moves in the axial direction is provided on the apparatus body side and a twisted hole having a polygonal cross-section is formed in the driving shaft while a polygonal columnar protrusion that is inserted into the twisted hole of the driving shaft and transmits the driving force is included on the photosensitive drum side as the bearing member. The protrusion described in Patent Document 1 has a twisted column shape corresponding to the twisted hole of the driving shaft. On the other hand, the protrusion described in Patent Document 2 has a columnar shape that is not twisted.

In any of the techniques described in Patent Documents 1 and 2, an object thereof is to enhance the rotational precision of the photosensitive drum and reliably transmit the driving force to the photosensitive drum from the apparatus body.

RELATED ART DOCUMENT

Patent Document

[Patent Document 1] JP-A-H08-328449
[Patent Document 2] JP-A-H10-153941

DISCLOSURE OF THE INVENTION

Problem that the Invention is to Solve

However, in the technique in which the twisted hole and the twisted columnar protrusion corresponding to the hole are included as described in Patent Document 1, when the twisted columnar protrusion is manufactured by injection molding, there is a tendency of a mold structure to become complex and increase in size because rotation is needed according to the torsion of the columnar protrusion. In addition, it is difficult to manufacture a mold capable of simultaneously molding a plurality of end portion members having the twisted columnar protrusion due to the fact that the mold structure becomes complex and increases in size.

In addition, in the technique described in Patent Document 1, when the process cartridge is separated from the apparatus body, in order to separate the twisted columnar protrusion as the bearing member from the twisted hole of the driving shaft, the twisted columnar protrusion needs to be rotated in the reverse direction to the driving direction. Accordingly, separation may not be smoothly performed.

In addition, the problem is not limited to this, and it cannot be said that the bearing member having the columnar protrusion as described in Patent Documents 1 and 2 is certainly sufficient to smoothly perform engagement and separation with and from the driving shaft of the apparatus body with sufficient rotation transmission precision. For example, when the relationship between the shapes of the hole of the driving shaft and the bearing member is not good, the driving force is not appropriately transmitted. In addition, the area of the contact parts of the two is reduced, and thus the force is concentrated, resulting in flaws and dents, and therefore defects in function and in appearance occur.

In order to solve the problems, an object of the invention is to provide an end portion member which enables smooth attachment and detachment between an apparatus body and a photosensitive drum while sufficiently transmitting a rotational driving force with suppressing occurrence of flaws and dents on the driving shaft and the bearing member, and has excellent productivity.

In addition, a photosensitive drum unit using the end portion member, and a process cartridge including the same are provided.

Means for Solving the Problem

According to a first aspect of the present invention, there is provided an end portion member which is disposed at an end portion of a photosensitive drum unit that is detachably mounted to an image forming apparatus body which includes a driving shaft having a recessed portion which is a twisted hole with a substantially triangular cross-sectional shape, comprising:

a convex bearing member which is able to be engaged with and be separated from the recessed portion, wherein the bearing member has no undercut portion in an axial direction of an outer peripheral surface thereof and an outer peripheral shape thereof in a cross-section orthogonal to the axial direction is a hexagon, and assuming that a radius of a circumscribed circle of a smallest triangle including the substantially triangular cross-sectional shape of the recessed portion is $R_{1h}$ and a radius of a circumscribed circle of a single triangle including three sides that are not adjacent among sides constituting the hexagonal cross-section of the bearing member is $R_{1p}$, $$0.85 \leq R_{1p}/R_{1h} \leq 1.07.$$

Here, the conception that the recessed portion is "a twisted hole with a substantially triangular cross-sectional shape" includes a shape which is assumed to be a triangle if the triangle is formed by extending three sides other than portions where vertexes of a triangle are cut off, under the condition that the cross-sectional shape is a polygon formed by, for example, cutting off the vertexes.

In this case, therefore, "a radius of a circumscribed circle of a smallest triangle including the substantially triangular cross-sectional shape of the recessed portion is $R_{1h}$" means that the assumed triangle is included in the smallest triangle, and a radius of a circumscribed circle of the triangle is determined as $R_{1h}$.

A shape of the hexagonal cross-section of the bearing member may include a corrected shape, the corrected shape may be defined as a shape where an inclined angle of one pair of sides among three sides which are not adjacent and without contributing to transmit the rotational driving force, before correction is corrected with a correction angle $\theta_1$, and the correction angle $\theta_1$ may be set such that, when $R_{1p}/R_{1h}$ is 0.85 or higher and 0.93 or less, $\theta_1$ is 0.1° or higher and 10° or less.

While the recessed portion and the bearing member are in an attitude of being engaged with each other to transmit a rotational force, assuming that a contact length between a ridge line of an opening of the recessed portion and the bearing member is $L_c$, an angle between a contact part of the bearing member and the ridge line of the recessed portion is $\theta_m$, and a correction angle changed from the hexagon as a base body to reduce $\theta_m$ is $\theta_2$, $\theta_2$ may be 0.1° or higher and 10° or less when $R_{1p}/R_{1h}$ is 0.85 or higher and 0.93 or less.

While the recessed portion and the bearing member are in an attitude of being engaged with each other to transmit a rotational force, assuming that a contact length between a ridge line of an opening of the recessed portion and the bearing member is $L_c$, an angle between a contact part of the bearing member and the ridge line of the recessed portion is $\theta_m$, and a correction angle to change the hexagon before correction to correct $\theta_m$ is $\theta_2$, $\theta_2$ may be −10° or higher and −0.1° or less when $R_{1p}/R_{1h}$ is 0.96 or higher and 1.07 or less.

Assuming that intersections between a shape formed at the opening of the recessed portion when the recessed portion is viewed from a front in the axial direction and a shape formed at a bottom of the recessed portion are vertices, a radius of a largest circle that comes into contact with an inside of a shape enclosed by the vertices is $R_{3h}$, and a radius of a circumscribed circle of the hexagon of the bearing member is $R_{2p}$, it is preferable that $$R_{2P}-R_{3h}>0 \text{ mm}.$$

When a member that forms the recessed portion is made of a nonmetallic material, it is preferable that $$R_{2P}-R_{3h}>1 \text{ mm}.$$

$L_c$ may be 0.5 mm or higher, where $L_c$ is a contact length between a ridge line of an opening of the recessed portion and the bearing member, at a posture where the recessed portion and the bearing member are engaged and enable rotational driving force transmitted therebetween.

$\theta_m$ may be 5° or less, where a ridge line of an opening of the recessed portion and the bearing member are contacted with each other, and $\theta_m$ is an angle between a portion contacting the bearing member and the ridge line of the recessed portion, at a posture where the recessed portion and the bearing member are engaged and enable rotational driving force transmitted therebetween.

Assuming that a torsion angle of the recessed portion is $\theta_a$, and a rotation angle between a single triangle including three sides that are not adjacent among sides constituting the hexagon of the bearing member and another triangle including three sides that are not included in the single triangle among the sides constituting the hexagon is $\theta_p$, it is preferable that $$0.5 \leq \theta_p/\theta_a \leq 1.5.$$

While the bearing member is in an attitude of being engaged with the recessed portion, a volume in which the recessed portion and the bearing member interfere with each other outside a part where the ridge line of the opening of the recessed portion and the bearing member come into contact with each other may be 1 $mm^3$ or less.

Regarding the bearing member, in the hexagonal outer peripheral shape of the bearing member, outside the part where the ridge line of the opening of the recessed portion and the bearing member come into contact with each other, at least a part of the hexagon of the bearing member may be cut out.

The bearing member may be divided into two or more sections.

In the hexagonal outer peripheral shape of the bearing member, outside the part where the ridge line of the opening of the recessed portion and the bearing member come into contact with each other, the bearing member may have a chamfered portion.

The chamfered portion may be a free curved surface.

According to another aspect of the present invention, there is provided a photosensitive drum unit comprising:

a cylindrical photosensitive drum; and the end portion member according to any one of the above, which is mounted to at least one end portion of the photosensitive drum.

According to still another aspect of the present invention, there is provided a process cartridge comprising:

the photosensitive drum unit according to the above;

a charging roll which charges the photosensitive drum of the photosensitive drum unit; and a developing roll which develops an electrostatic latent image onto the photosensitive drum.

According to still another aspect of the present invention, there is provided an end portion member which is disposed at an end portion of a photosensitive drum unit that is detachably mounted to an image forming apparatus body which includes a driving shaft having a recessed portion which is a twisted hole with a substantially triangular cross-sectional shape, comprising:

a cylindrical or columnar bearing member which is able to be engaged with and be separated from the recessed portion, wherein the bearing member has no undercut portion on an outer peripheral surface in a direction along an axis, and while the bearing member is in an attitude of being engaged into the recessed portion, at any part where the bearing member comes into contact with the recessed portion, a cross-sectional area occupancy ratio which is a degree of area occupied by a cross-section of the bearing member with respect to a cross-section of the recessed portion in a cross-section orthogonal to a direction in which the axis extends is 15% or higher and 75% or less, and an outer peripheral shape of the bearing member in a cross-section orthogonal to the direction in which the axis extends is a hexagon, and assuming that a radius of a circumscribed circle of the hexagon of the bearing member is $r_{1g}$, and when a hexagon is formed by sides enclosed by a triangle formed at an opening of the recessed portion when the recessed portion is viewed from a front in the axial direction and a triangle formed at a bottom of the recessed portion, a radius of an inscribed circle of the hexagon of the recessed portion is $r_{2h}$, $$r_{1g}-r_{2h}>0.$$

The cross-sectional area occupancy ratio may be 20% or higher and 70% or less.

Regarding the bearing member, while the bearing member is in the attitude of being engaged into the recessed portion, a volume occupancy ratio which is a degree of volume occupied by the bearing member with respect to a capacity of the recessed portion may be 20% or higher and 70% or less.

The bearing member may be divided into two or more sections.

In the hexagonal outer peripheral shape of the bearing member, outside a part where a ridge line of the opening of the recessed portion and the bearing member come into contact with each other, the bearing member may have a chamfered portion.

According to still another aspect of the present invention, there is provided an end portion member which is disposed at an end portion of a photosensitive drum unit that is detachably mounted to an image forming apparatus body which includes a driving shaft having a recessed portion which is a twisted hole with a substantially triangular cross-sectional shape, comprising:

a cylindrical or columnar bearing member which is able to be engaged with and be separated from the recessed portion, wherein the bearing member has no undercut portion in an axial direction of an outer peripheral surface thereof, and while the bearing member is in an attitude of being engaged into the recessed portion, a volume occupancy ratio which is a degree of volume occupied by the bearing member with respect to a capacity of the recessed portion is 20% or higher and 70% or less, and an outer peripheral shape of the bearing member in a cross-section orthogonal to the axial direction is a hexagon, and assuming that a radius of a circumscribed circle of the hexagon of the bearing member is $r_{1g}$, and when a hexagon is formed by sides enclosed by a triangle formed at an opening of the recessed portion when the recessed portion is viewed from a front in the axial direction and a triangle formed at a bottom of the recessed portion, a radius of an inscribed circle of the hexagon of the recessed portion is $r_{2h}$, $$r_{1g}-r_{2h}>0.$$

The volume occupancy ratio may be 30% or higher and 70% or less.

The bearing member may be divided into two or more sections.

In the hexagonal outer peripheral shape of the bearing member, outside a part where a ridge line of the opening of the recessed portion and the bearing member come into contact with each other, the bearing member may have a chamfered portion.

According to still another aspect of the present invention, there is provided a photosensitive drum unit comprising:

a cylindrical photosensitive drum; and the end portion member according to any one of the above, which is mounted to at least one end portion of the photosensitive drum.

According to still another aspect of the present invention, there is provided a process cartridge comprising:

the photosensitive drum unit according to the above;

a charging roll which charges the photosensitive drum of the photosensitive drum unit; and a developing roll which develops an electrostatic latent image onto the photosensitive drum.

Advantage of the Invention

According to the invention, the end portion member which includes the bearing member which sufficiently transmits the rotational driving force from the apparatus body to the photosensitive drum, enables smooth attachment and detachment between the apparatus body and the photosensitive drum unit, and has excellent productivity in the end portion member can be provided. In addition, when the rotational driving force is transmitted, it is possible to suppress generation of deformation such as flaws and dents in the driving shaft and the bearing member.

DETAILED DESCRIPTION OF EMBODIMENT

Figure 1:
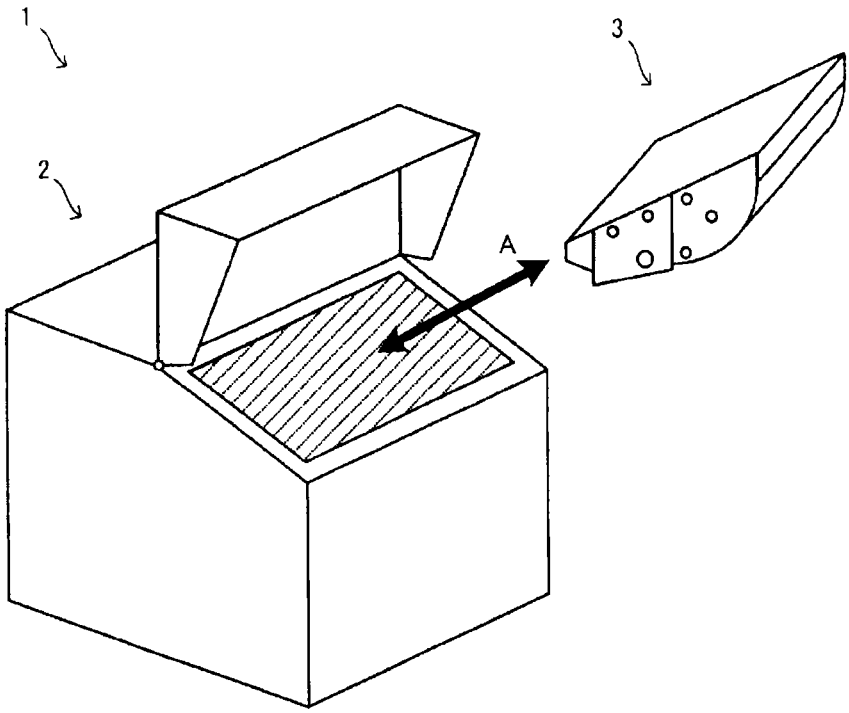
FIG. 1 is a schematic diagram of an image forming apparatus according to a first embodiment.

The effects and advantages of the invention described above are clarified from the best mode for carrying out the invention described as follows. Hereinafter, the invention will be described on the basis of embodiments illustrated in the drawings. However, the invention is not limited to the embodiments.

First Embodiment

FIG. 1 is a diagram illustrating a first embodiment, and is a perspective view schematically illustrating a process cartridge 3 included in an image forming apparatus 1 and an image forming apparatus body 2 (hereinafter, may be referred to as an "apparatus body") to which the process cartridge 3 is mounted. As illustrated in FIG. 1, the image forming apparatus 1 includes the apparatus body 2 and the process cartridge 3. The process cartridge 3 can be mounted to and separated from the apparatus body 2 by being moved in a direction indicated by A in FIG. 1.

The apparatus body 2 has a driving shaft 51 which is described below. Other parts may use well-known configurations.

Figure 2A:
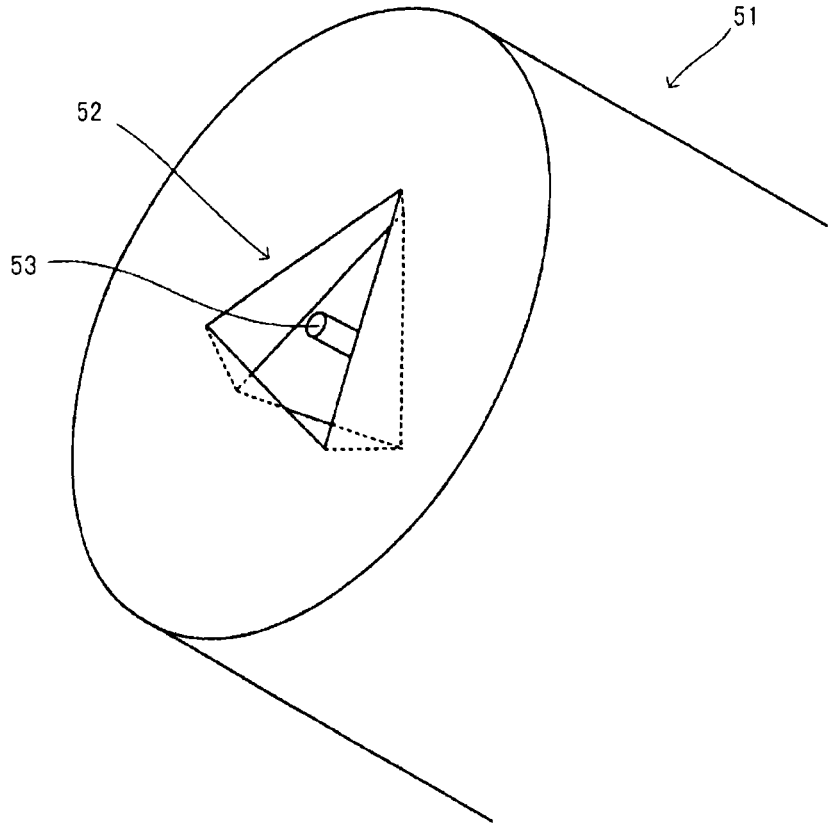
FIG. 2A is a perspective view illustrating one end side of a driving shaft.
Figure 2B:
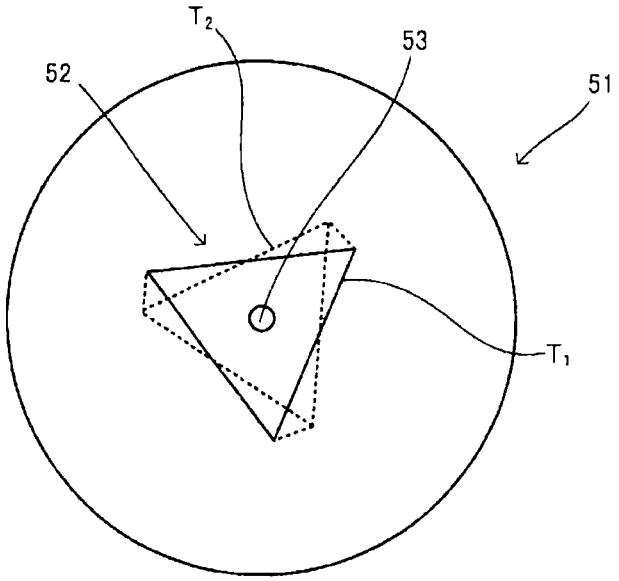
FIG. 2B is a front view illustrating one end side of the driving shaft.
Figure 3:
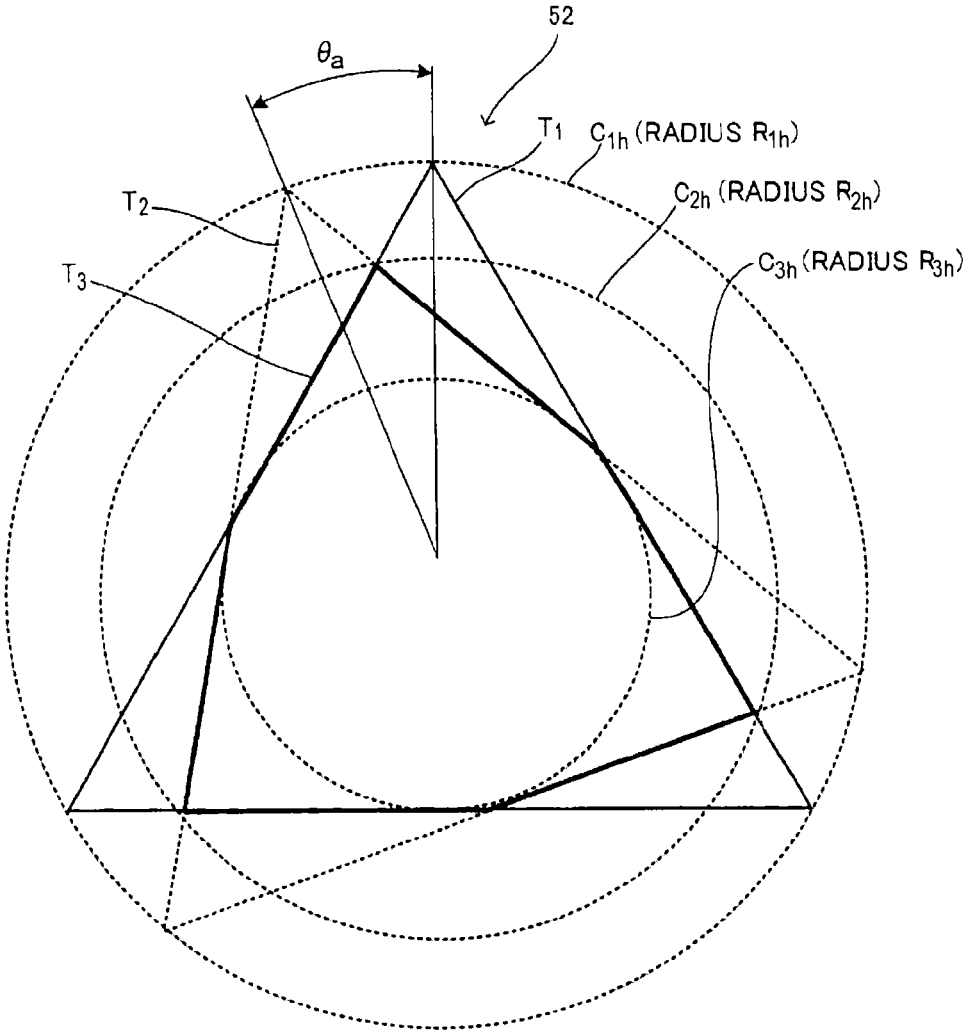
FIG. 3 is a diagram illustrating the shape of a recessed portion.

First, the driving shaft 51 provided in the apparatus body 2 will be described. In FIG. 2, in the driving shaft 51 that is provided in the apparatus body 2 and exerts a rotational driving force to a photosensitive drum unit 10, an end portion on a side that is engaged with a bearing member 30 (see FIG. 7) is illustrated. FIG. 2A is a perspective view, and FIG. 2B is a front view. In FIGS. 2A and 2B, a part of a recessed portion 52 is seen through and is indicated by broken lines. An end portion on the opposite side to the driving shaft 51 is directly or indirectly connected to a driving source of the apparatus body 2. In addition, FIG. 3 illustrates a diagram illustrating the shape of the recessed portion 52. FIG. 3 has the same viewpoint as FIG. 2B.

As can be seen from FIGS. 2A and 2B, the end portion of the driving shaft 51 is provided with the recessed portion 52. The recessed portion 52 has a cross-section in a substantially equilateral triangle shape, and is a hole that has such a shape that is twisted about the axis by a predetermined angle toward a depth direction from the end surface of the driving shaft 51 in the axial direction. In addition, from the bottom of the recessed portion 52, a cylindrical protrusion 53 is erected along the axis at the axial core position of the driving shaft 51. Therefore, the recessed portion 52 is formed with the opening at the end of the driving shaft 52, and formed in a container shape having a height in the axial direction and a bottom portion.

In addition, as can be seen from FIG. 2B, when the recessed portion 52 is seen through from the front in the axial direction, a triangle ($T_1$) formed at the opening of the recessed portion 52 and a triangle ($T_2$) formed at the bottom of the recessed portion 52 are seen as two overlapping triangles rotated about the axis. From this form, the following characteristics are defined. FIG. 3 illustrates a diagram for explanation. FIG. 3 is based on the same viewpoint as FIG. 2B and pays attention to the recessed portion 52.

In FIGS. 2B and 3, the triangle formed at the opening of the recessed portion 52 is denoted by reference numeral $T_1$, and the triangle formed at the bottom of the recessed portion 52 is denoted by reference numeral $T_2$. Here, when the recessed portion 52 is viewed from the viewpoint of FIG. 3, on the inside enclosed by the two triangles $T_1$ and $T_2$, a shape $T_3$ having the intersections between the triangles $T_1$ and $T_2$ as its vertices is formed (the shape $T_3$ is indicated by a thick line in FIG. 3). In this form, the shape $T_3$ is a hexagon. The following shape is defined from the recessed portion 52.

The circumscribed circle of the triangles $T_1$ and $T_2$ is denoted by $C_{1h}$, and the radius of the circumscribed circle $C_{1h}$ is denoted by $R_{1h}$. In this form, $T_1$ and $T_2$ are formed as complete triangles. However, the corresponding shape of the recessed portion may be formed as a polygon made by cutting out the vertices of a triangle. In this case, the triangles $T_1$ and $T_2$ are defined as smallest triangles including the corresponding polygon.

The rotation angle between the triangles $T_1$ and $T_2$ (that is, the torsion angle of the recessed portion 52) is denoted by $\theta_a$.

The circumscribed circle of the shape $T_3$ is denoted by $C_{2h}$, and the radius of the circumscribed circle $C_{2h}$ is denoted by $R_{2h}$. In addition, the largest circle that comes into contact with the inside of the shape $T_3$ and is inscribed therein is denoted by $C_{3h}$, and the radius of the circle $C_{3h}$ is denoted by $R_{3h}$.

Figure 4A:
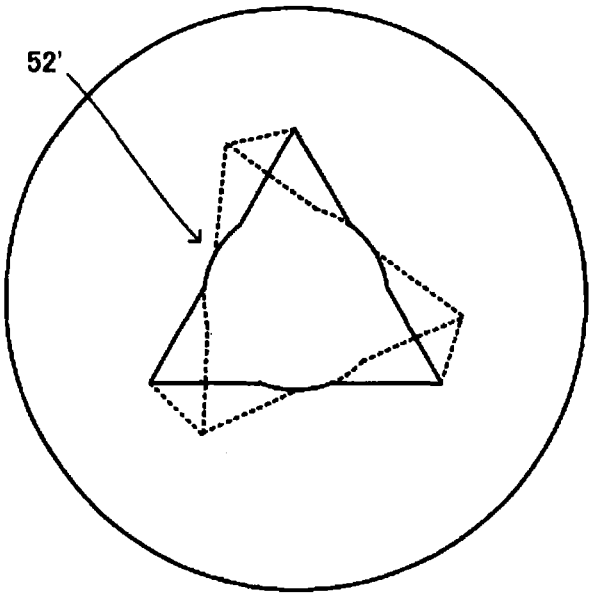
FIG. 4A is a front view illustrating another example of the recessed portion.
Figure 4B:
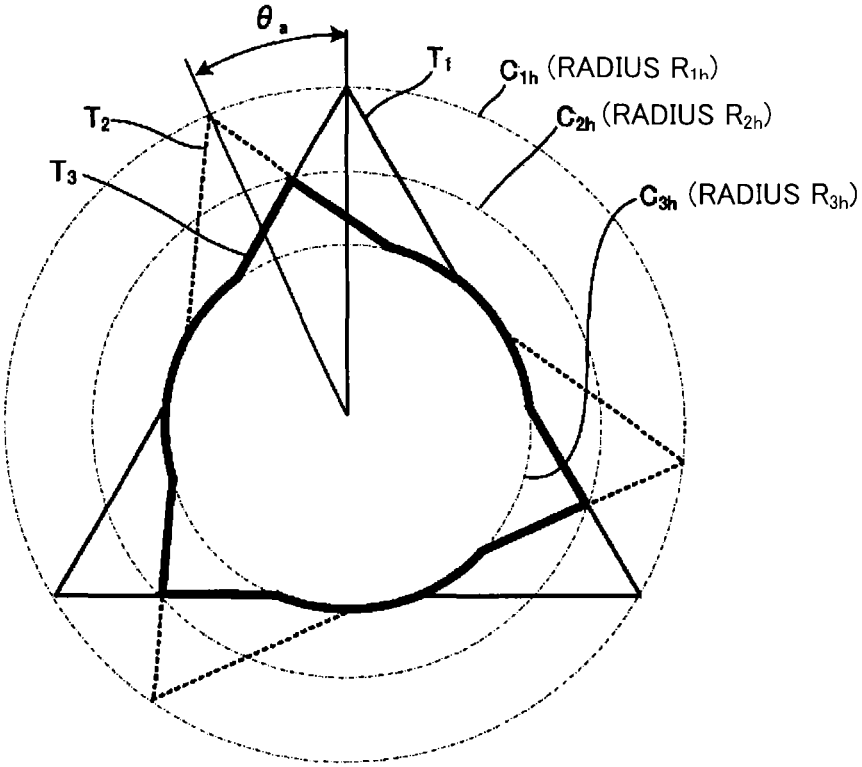
FIG. 4B is a diagram illustrating the shape of another example of the recessed portion.

FIG. 4 illustrates diagrams illustrating a recessed portion 52' that is a modification example of the recessed portion. FIG. 4A corresponds to FIG. 2B, and FIG. 4B corresponds to FIG. 3. The recessed portion 52' has a shape in which, in addition to the recessed portion 52, arcs are shown to be cut out the inside thereof by a circle about the axis. Even in this case, as illustrated in FIG. 4B, each shape in the recessed portion can be defined. Here, the circle $C_{3h}$ is a circle that forms the corresponding arcs that are shown to be cut out.

The relationship between each shape described above and the bearing member 30 (see FIG. 7) will be described below.

Figure 5:
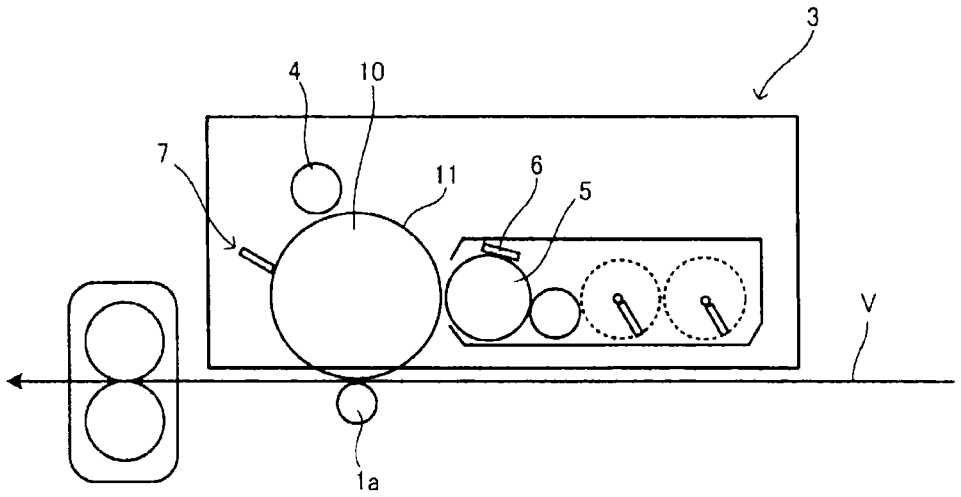
FIG. 5 is a diagram conceptually illustrating the structure of a process cartridge.

Next, the process cartridge 3 is described. FIG. 5 schematically illustrates the structure of the process cartridge 3. As can be seen from FIG. 5, the process cartridge 3 has the photosensitive drum unit 10 (see FIG. 6), a charging roller 4, a developing roller 5, a regulating member 6, and a cleaning blade 7. While the process cartridge 3 is in an attitude of being mounted to the apparatus body 2, a recording medium such as paper is moved along line indicated by V in FIG. 5, thereby transferring an image on the corresponding recording medium.

In addition, attachment and detachment of the process cartridge 3 to and from the apparatus body 2 are generally performed as follows. Since the photosensitive drum unit 10 included in the process cartridge 3 is rotated by receiving the rotational driving force from the apparatus body 2, the driving shaft 51 (see FIG. 2) of the apparatus body 2 and the bearing member 30 (see FIG. 7) of the photosensitive drum unit 10 need to be engaged with each other at least during operation. On the other hand, during attachment and detachment of the process cartridge 3 to and from the apparatus body 2, the engagement between the driving shaft 51 of the apparatus body 2 and the bearing member 30 of the photosensitive drum unit 10 needs to be released.

Here, the driving shaft 51 of the apparatus body 2 is configured to be movable in the axial direction, and during attachment and detachment of the process cartridge 3, the driving shaft 51 is in an attitude of being separated from the bearing member 30 of the photosensitive drum unit 10. On the other hand, after the process cartridge 3 is mounted to the apparatus body 2, the driving shaft 51 is moved to be engaged with the bearing member 30 of the photosensitive drum unit 10.

As described above, it is preferable that the driving shaft 51 of the apparatus body 2 and the bearing member 30 of the photosensitive drum unit transmit an appropriate rotational driving force and be smoothly engaged and separated from each other.

Hereinafter, each configuration will be described.

As described above, in the process cartridge 3, the charging roller 4, the developing roller 5, the regulating member 6, the cleaning blade 7, and the photosensitive drum unit 10 are provided, and each thereof is described below.

The charging roller 4 charges a photosensitive drum 11 of the photosensitive drum unit 10 by applying a voltage from the image forming apparatus body 2. This is performed by causing the charging roller 4 to follow the photosensitive drum 11 to be rotated, and then come into contact with the outer peripheral surface of the photosensitive drum 11.

The developing roller 5 is a roller that supplies a developer to the photosensitive drum 11. In addition, an electrostatic latent image formed on the photosensitive drum 11 is developed by the developing roller 5. In addition, the developing roller 5 has a stationary magnet embedded therein.

The regulating member 6 is a member that adjusts the amount of the developer attached to the outer peripheral surface of the developing roller 5 and imparts triboelectrification charges to the developer itself.

The cleaning blade 7 is a blade that comes into contact with the outer peripheral surface of the photosensitive drum 11 and removes the developer that remains after transfer using its tip end.

Figure 6:
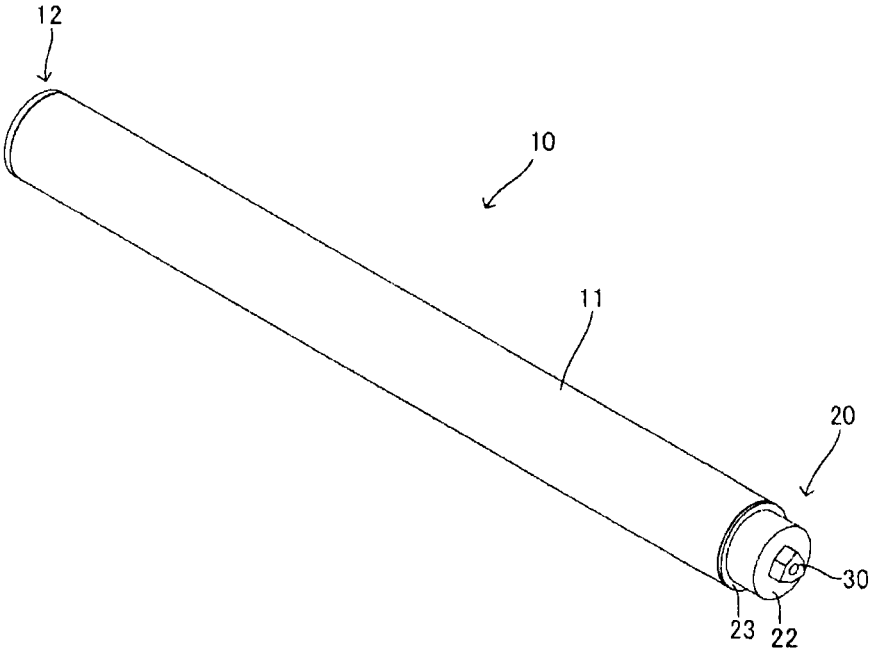
FIG. 6 is a perspective view of the external form of a photosensitive drum unit.

The photosensitive drum unit 10 is provided with the photosensitive drum 11 to form text, figures, and the like thereon to be transferred onto a recording medium. FIG. 6 illustrates a perspective view of the external form of the photosensitive drum unit 10. As can be seen from FIG. 6, the photosensitive drum unit 10 is provided with the photosensitive drum 11, a lid material 12, and an end portion member 20.

The photosensitive drum 11 is a member made by coating the outer peripheral surface of a cylindrical base body with a photosensitive layer. The text, figures, and the like to be transferred onto the recording medium such as paper are formed on the photosensitive layer.

The base body is made by forming a conductive material made of aluminum or an aluminum alloy in a cylindrical shape. The type of the aluminum alloy used for the base body is not particularly limited, and 6000 series, 5000 series, and 3000 series aluminum alloys defined in the JIS standards (JIS H 4140), which are generally used as the base body of the photosensitive drum, are preferable.

In addition, the photosensitive layer formed on the outer peripheral surface of the base body is not particularly limited, and well-known layers may be applied depending on the purpose.

The base body may be manufactured by forming a cylindrical shape through cutting, extrusion, drawing, or the like. In addition, it is possible to manufacture the photosensitive drum 11 by applying the photosensitive layer onto the outer peripheral surface of the base body to be laminated thereon.

As described later, the end portion member 20 is mounted to one end of the photosensitive drum 11, and the lid material 12 is disposed at the other end thereof.

The lid material 12 is a member formed from a resin, and a fitting portion fitted into the cylindrical inside of the photosensitive drum 11 and a bearing portion disposed to cover one end surface of the photosensitive drum 11 are coaxially assembled to each other. The bearing portion has a disc shape that covers an end surface of the photosensitive drum 11 and is provided with a shaft-receiving part. In addition, an earthing plate made of a conductive material is disposed in the lid material 12, and accordingly, the photosensitive drum 11 and the apparatus body 2 are electrically connected to each other.

In addition, although an example of the lid material is described in this embodiment, the lid material is not limited thereto, and it is possible to apply other forms of lid materials that can be typically employed. For example, a gear for transmitting a rotational force to the lid material may also be disposed.

In addition, the conductive material may also be provided on the end portion member 20 side which will be described later.

Figure 7:
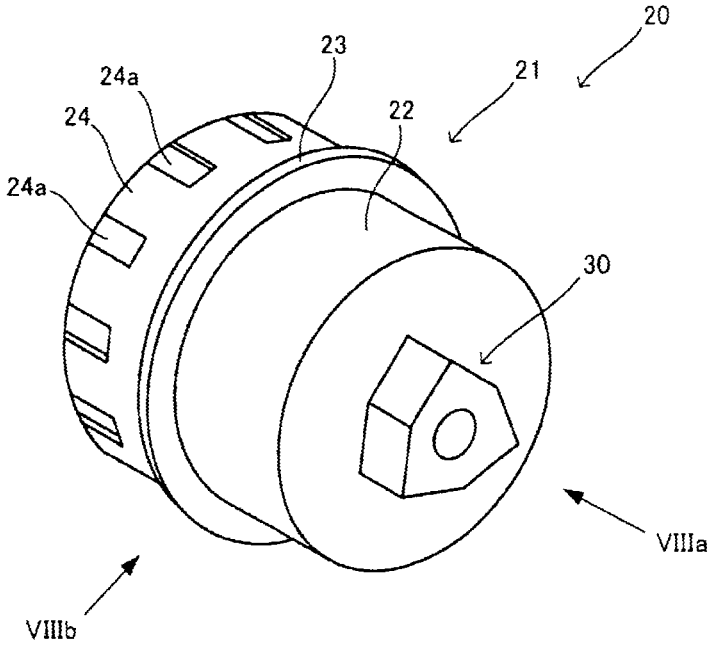
FIG. 7 is a perspective view of the external form of an end portion member.
Figure 8A:
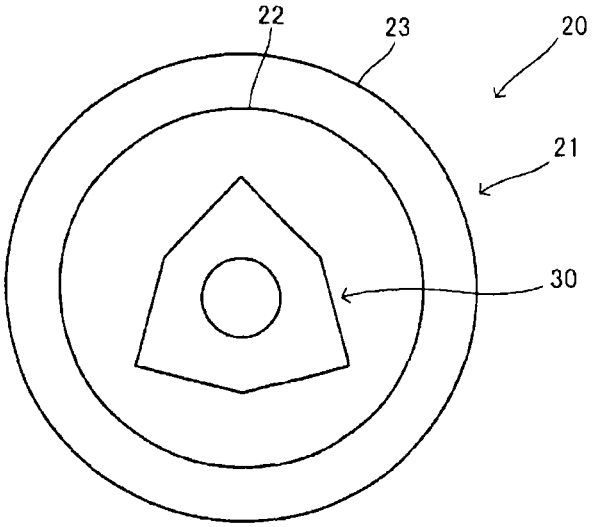
FIG. 8A is a front view of the end portion member.
Figure 8B:
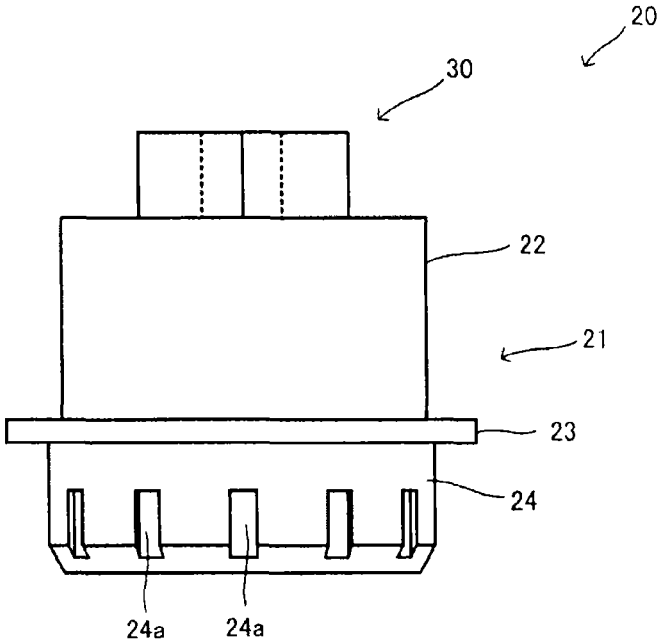
FIG. 8B is a side view of the end portion member.

The end portion member 20 is a member mounted to an end portion on the opposite side to the lid material 12 among the end portions of the photosensitive drum 11 and is provided with a body 21 and the bearing member 30. FIG. 7 illustrates a perspective view of the end portion member 20. In addition, FIGS. 8A and 8B illustrate a front view and a side view of the end portion member 20. FIG. 8A is a front view of the end portion member 20 viewed from a direction indicated by Villa in FIG. 7, and FIG. 8B is a side view of the end portion member 20 viewed from a direction indicated by VIIIb in FIG. 7.

As can be seen from FIGS. 6 to 8, in this embodiment, the end portion member 20 is configured by integrating the body 21 with the bearing member 30. In addition, the end portion member 20 receives the rotational driving force as the body 21 is mounted to the photosensitive drum 11 and the bearing member 30 provided to be integrated with the body 21 is engaged with the driving shaft 51 of the apparatus body 2, thereby rotating the photosensitive drum unit 10.

The body 21 is provided with a cylindrical body 22, a contact wall 23 that comes into contact with the end surface of the photosensitive drum 11 to be locked, and a fitting portion 24 inserted into the inside of the photosensitive drum 11.

The cylindrical body 22 is a cylindrical member with a bottom, in which one end portion has the bottom and the other end portion has the contact wall 23. In the cylindrical body 22, the bearing member 30 is provided to protrude outward from the corresponding bottom.

The contact wall 23 is a ring-like (annular) member that is provided at the end portion on the opposite side to the side where the bearing member 30 is provided among the end portions of the cylindrical body 22 and is erected from the outer peripheral surface of the cylindrical body 22. As can be seen from FIG. 6, the contact wall 23 is disposed to come into contact with the end surface of the photosensitive drum 11 while the end portion member 20 is in an attitude of being mounted to the photosensitive drum 11. Accordingly, the insertion depth of the end portion member 20 into the photosensitive drum 11 is restricted.

The fitting portion 24 is a cylindrical part that protrudes toward the opposite side to the side where the cylindrical body 22 is provided, in the contact wall 23. The fitting portion 24 is inserted into the inside of the photosensitive drum 11 and is fixed to the inner surface of the photosensitive drum 11 by an adhesive. Accordingly, the end portion member 20 is fixed to the end portion of the photosensitive drum 11. Therefore, the outside diameter of the fitting portion 24 is substantially the same as the inside diameter of the photosensitive drum 11 in a range in which the outside diameter thereof can be inserted into the cylindrical inside of the photosensitive drum 11.

Grooves 24*a* may also be formed on the outer peripheral surface of the fitting portion 24. Accordingly, the grooves 24*a* are filled with the adhesive, and the adhesion between the end portion member 20 and the photosensitive drum 11 is enhanced by the anchor effect or the like.

The bearing member 30 is a convex member which is engaged with the recessed portion 52 provided in the driving shaft 51 of the above-described apparatus body 2 and has a function of transmitting the rotational force from the driving shaft 51 to the end portion member 20. In addition, when the process cartridge 3 is attached to or detached from the apparatus body 2, the bearing member 30 is configured to be separated from the recessed portion 52 of the driving shaft 51. Specifically, the bearing member 30 of this embodiment has the following shape.

Figure 9:
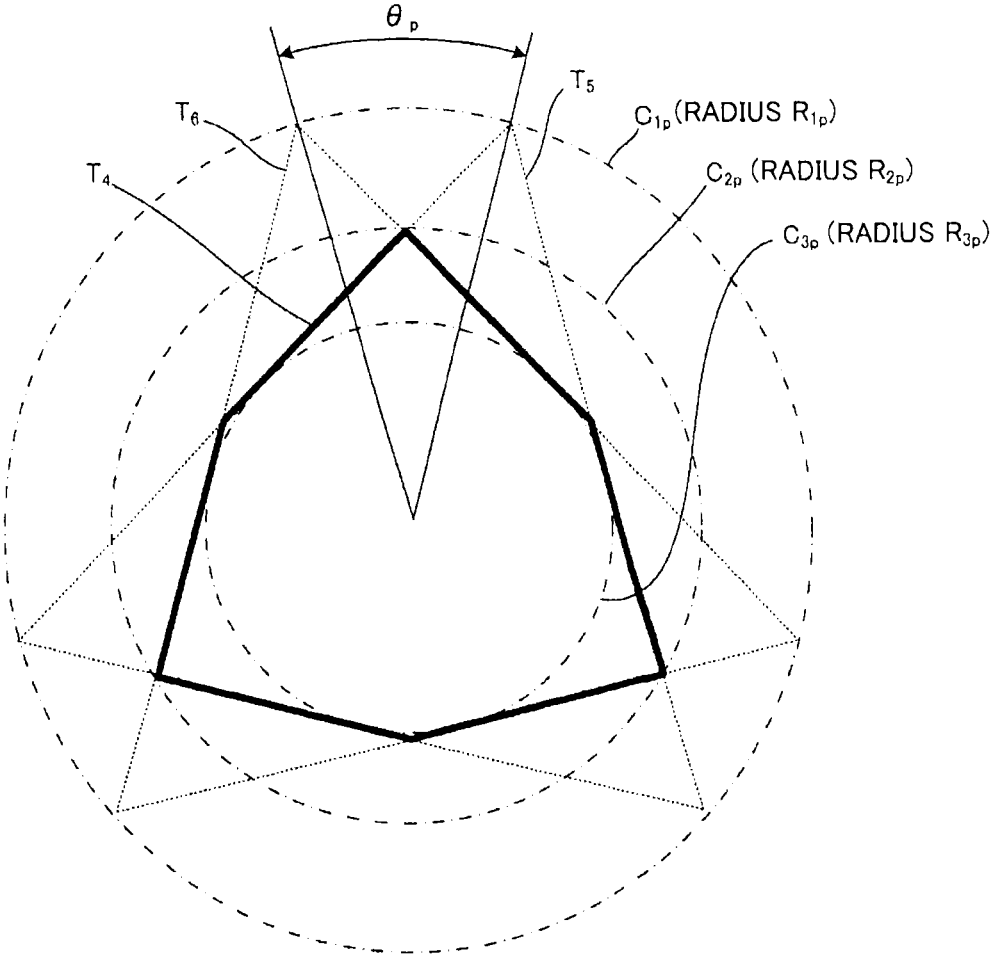
FIG. 9 is a diagram illustrating the shape of a bearing member.

As can be seen from FIGS. 8A and 8B, the bearing member 30 is a cylindrical body provided to protrude from the bottom of the cylindrical body 22 in the axial direction, and has a hexagonal outer peripheral shape in a cross-section orthogonal to the axial direction and a circular inner peripheral shape. FIG. 9 illustrates a diagram illustrating the shape of the bearing member 30 by enlarging the hexagonal part of the bearing member 30 in FIG. 8A.

In FIG. 9, the hexagon of the outer peripheral shape of the bearing member 30 is denoted by $T_4$ (the shape $T_4$ is indicated by the thick line in FIG. 9). From the bearing member 30, the following shape is defined.

Among the sides constituting the hexagon $T_4$, the smallest triangle including three sides that are not adjacent is denoted by $T_5$. In addition, among the sides constituting the hexagon $T_4$, the smallest triangle including three sides that are not included in the triangle $T_5$ is denoted by $T_6$. In addition, the circumscribed circle of the triangles $T_5$ and $T_6$ is denoted by $C_{1p}$, and the radius of the circumscribed circle $C_{1p}$ is denoted by $R_{1p}$.

The rotation angle between the triangles $T_5$ and $T_6$ is denoted by $\theta_p$.

The circumscribed circle of the hexagon $T_4$ is denoted by $C_{2p}$, the radius of the circumscribed circle $C_{2p}$ is denoted by $R_{2p}$. In addition, the largest circle that comes into contact with the inside of the hexagon $T_4$ and is inscribed therein is denoted by $C_{3p}$, and the radius of the circle $C_{3p}$ is denoted by $R_{3p}$.

In addition, the bearing member 30 does not have a so-called twisted shape in the axial direction and does not have an undercut part. The meaning of not having an undercut part is, when the bearing member 30 is viewed in the axial direction from the end portion on the root side (the end portion on the body 21 side) of the bearing member 30 (when the bearing member 30 is viewed from the rear surface side which is on the opposite side to that of FIG. 8A), other parts of the bearing member 30 are not seen.

Accordingly, filling and releasing of a material in and from a mold are enhanced when the bearing member 30 (the end portion member 20) is formed, and thus productivity is enhanced. In addition, a slide core and a rotating mechanism of a frame are unnecessary, and thus it is possible to simplify the configuration of the mold itself.

The inner peripheral shape of the bearing member 30 does not necessarily have a circular cross-section and may have any shape as long as it can be engaged with the recessed portion 52. In this embodiment, the bearing member 30 has the cylindrical body but may also have a solid columnar shape.

It is preferable that the end portion member 20 be formed of a crystalline resin. The crystalline resin has a good flow when being subjected to injection molding using a mold, and thus has good molding workability. In addition, the crystalline resin is crystallized and solidified even when it is not cooled to a glass-transition point and thus can be released from the mold. Therefore, it is possible to significantly enhance productivity. In addition, the crystalline resin has excellent heat resistance, solvent resistance, oil resistance, and grease resistance, has good friction and wear resistance and sliability, and is preferable as a material applied to the end portion member even from the viewpoint of rigidity and hardness.

Examples of the crystalline resin include polyethylene, polypropylene, polyamide, polyacetal, polyethylene terephthalate, polybutylene terephthalate, methylpentene, polyphenylene sulfide, polyether ether ketone, polytetrafluoroethylene, and nylon.

Among these, from the viewpoint of molding workability, it is preferable that a polyacetal-based resin be used.

In addition, from the viewpoint of increasing strength, glass fiber, carbon fiber, or the like may be filled.

A configuration in which the photosensitive drum 11 is electrically connected by providing a conductive plate (earthing plate) on the end portion member side provided with the bearing member 30 and causing the conductive plate to come into contact with an electrode provided on the driving shaft 51 side of the apparatus body 2 is possible. At this time, a method of forming the bearing member 30 itself of a conductive material, a method of exposing the conductive plate to the inner periphery of the bearing member 30, or the like may be employed.

Figure 10:
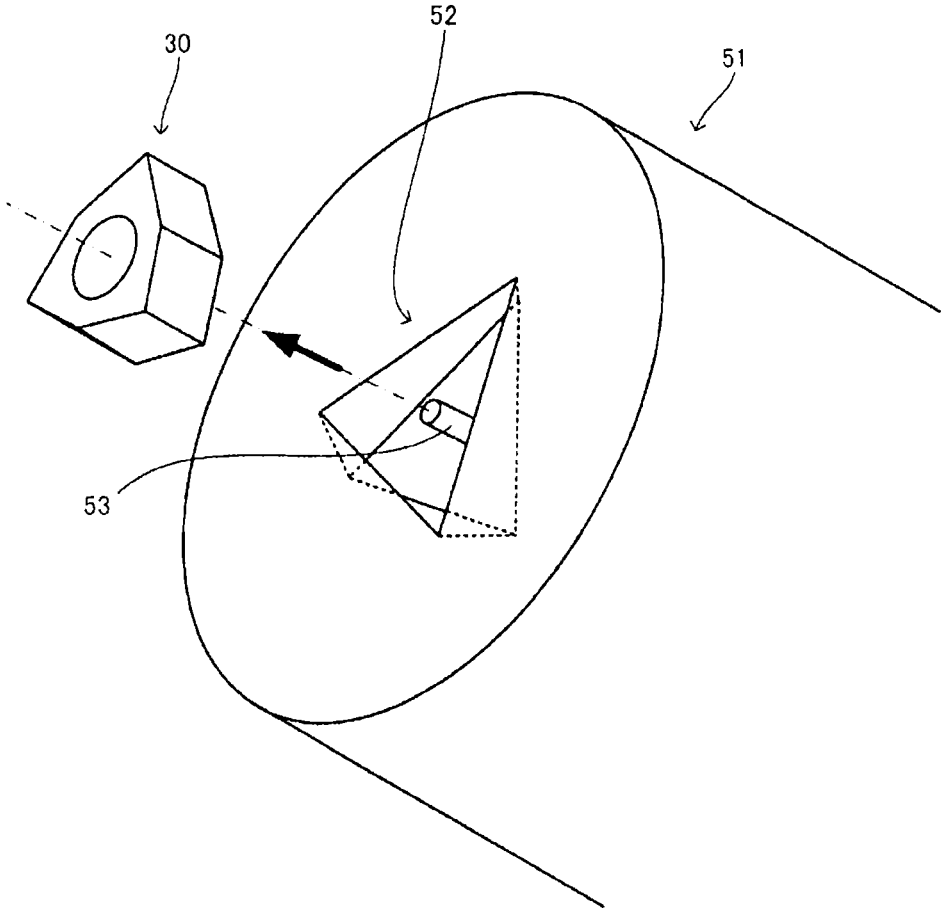
FIG. 10 is a perspective view illustrating engagement between the bearing member and the recessed portion of the driving shaft.
Figure 11:
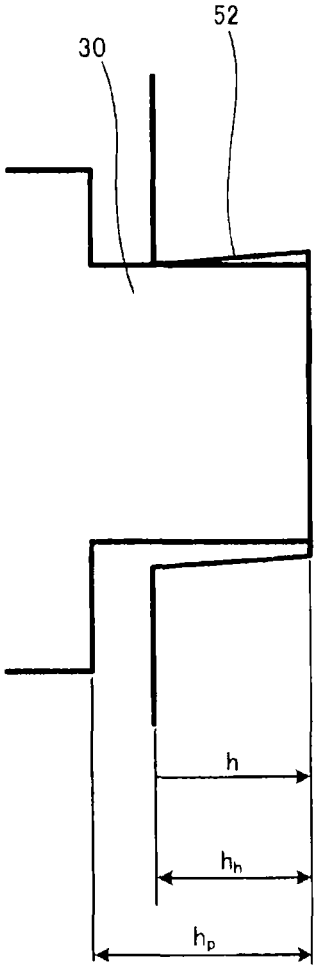
FIG. 11 is a diagram illustrating engagement between the bearing member and the recessed portion of the driving shaft and is a diagram schematically illustrating a cross-section in the axial direction.
Figure 12:
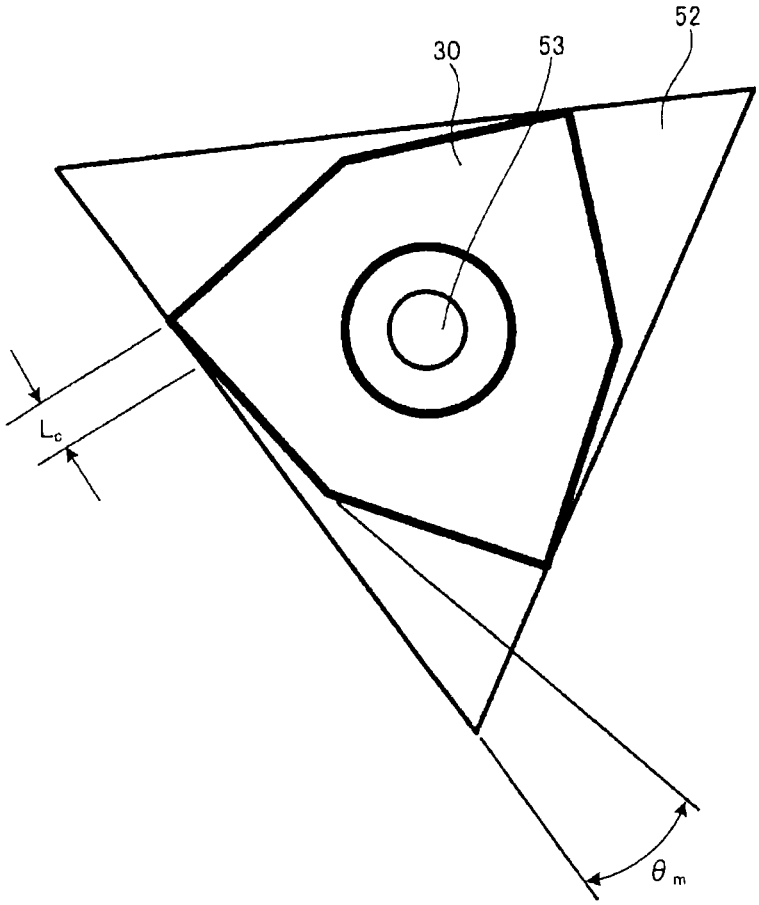
FIG. 12 is a front view illustrating the engagement between the bearing member and the recessed portion of the driving shaft.

FIGS. 10 to 12 illustrate schematic diagrams of a mode in which the bearing member 30 provided in the photosensitive drum unit 10 and the recessed portion 52 of the driving shaft 51 provided in the apparatus body 2 are engaged with each other. FIG. 10 is a perspective view schematically illustrating a figure of a procedure of the engagement. FIG. 11 is a diagram schematically illustrating a cross-section in the axial direction in an attitude of the recessed portion 52 and the bearing member 30 being engaged with each other. Therefore, in FIG. 11, a figure of the bearing member 30 inserted into the recessed portion 52 in the depth direction is illustrated. FIG. 12 is a front view illustrating the attitude of the recessed portion 52 and the bearing member 30 being engaged with each other at the end surface of the driving shaft 51.

As can be seen from FIG. 12, after the process cartridge 3 is mounted to the apparatus body 2, the driving shaft 51 is moved in the axial direction to insert the bearing member 30 into the inside of the recessed portion 52 thereof. In addition, after the insertion, as illustrated in FIG. 12, parts or the entirety of at least three surfaces among the outer peripheral surfaces of the hexagon of the bearing member 30 come into contact with the ridge lines on the end surface side of the recessed portion 52, and the two are engaged in an attitude capable of transmitting the rotational driving force about the axis. In addition, at this time, a protrusion 53 provided in the recessed portion 52 is inserted into the cylindrical inner space of the bearing member 30.

When the driving shaft 51 and the bearing member 30 are engaged with each other, the driving shaft 51, the bearing member 30, the body 21, and the photosensitive drum 11 are coaxial.

In addition, since the bearing member 30 has no undercut part, during engagement with the recessed portion 52 or during release in the opposite case, the bearing member 30 is smoothly operated.

From the attitude of the recessed portion 52 and the bearing member 30 engaged with each other, the following shape is defined.

As can be seen from FIG. 11, the size of the bearing member 30 in the axial direction is denoted by $h_p$. The size (depth) of the recessed portion 52 in the axial direction is denoted by $h_h$. Accordingly, the insertion depth is denoted by h. In the example illustrated in FIG. 11, since $h_p>h_h$, $h=h_h$. On the other hand, when $h_p<h_h$, $h=h_p$.

The torsion angle between the triangular cross-section shown at the end surface of the driving shaft 51 in the triangular cross-section of the recessed portion 52 and the triangular cross-section of the recessed portion 52 at the insertion depth h is denoted by $\theta_h$.

As can be seen from FIG. 12, the content length between the ridge line at the opening of the recessed portion 52 and the bearing member 30 is denoted by $L_c$, and the angle between the contact part of the bearing member 30 and the ridge line of the recessed portion 52 is denoted by $\theta_m$.

In addition, a correction angle changed from the hexagon as the base body in order to increase $L_c$ is denoted by $\theta_1$, and a correction angle changed from the hexagon as the base body in order to reduce $\theta_m$ is denoted by $\theta_2$.

Each of the shapes described above preferably has the following relationships.

$R_{1p}/R_{1h}$ is equal to or higher than 0.85 and equal to or lower than 1.07. In the case that this value is smaller than the range, the strength of the bearing member becomes weak, and the rotational driving force may not be appropriately transmitted; meanwhile engagement and separation between the bearing member and the recessed portion may not be smoothly performed when this value is larger than the range.

It is preferable that $R_{2P}-R_{3h}>0$ mm. By meeting this condition, the bearing member and the recessed portion can perform the transmission of the rotational driving force.

In the case that a portion of the driving shaft forming the recessed portion is made of a non-metal material, it is preferable that $R_{2P}-R_{3h}>1$ mm. By meeting this condition, a non-metal material (such as a resin) which may cause plastic deformation or rupture can be appropriately applied.

$L_c$ is preferably greater than 0.5 mm, more preferably greater than 1 mm, and most preferably greater than 1.5 mm. In the case that $L_c$ is shorter than or equal to 0.5 mm, rotational driving force can not be transmitted, and even if the rotational driving force can be transmitted, large flaws and dents may occur due to the reduction in contact parts.

It is preferable that $\theta_m$ is equal to or less than 5°. In the case that the angle becomes larger than this value, flaws and dents tend to occur due to the fact that edges of the bearing member strongly contact with the recessed portion.

It is preferable that $0.5\leq\theta_p/\theta_a\leq1.5$.

The volume of a part other than $L_c$ where the recessed portion 52 and the bearing member 30 interfere with each other is equal to or less than 1 $mm^3$. Absence or presence of the interference can be obtained by processing data of the recessed portion and the bearing member using a CAD or the like and combining the data. That is, the volume of the interference can be calculated by forming the recessed portion and the bearing portion on the CAD, assembling on the CAD, and simulating the state of these members engaging and transmitting the rotational driving force.

The above described outer peripheral shape (hexagonal shape) of the bearing member 30 may be corrected so as to improve transmission of the rotational driving force and to suppress flaws.

Figure 13A:
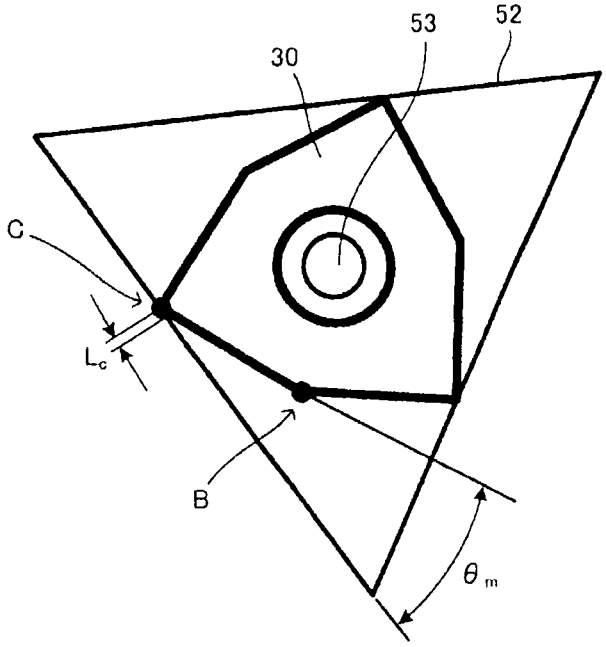
FIG. 13A is a diagram illustrating a state without applying a correction angle $\theta_2$.
Figure 13B:
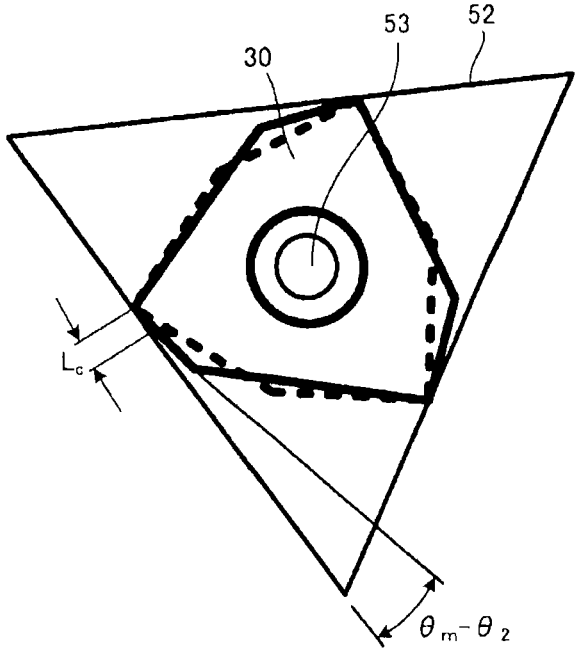
FIG. 13B is a diagram illustrating a correction angle $\theta_2$.
Figure 14A:
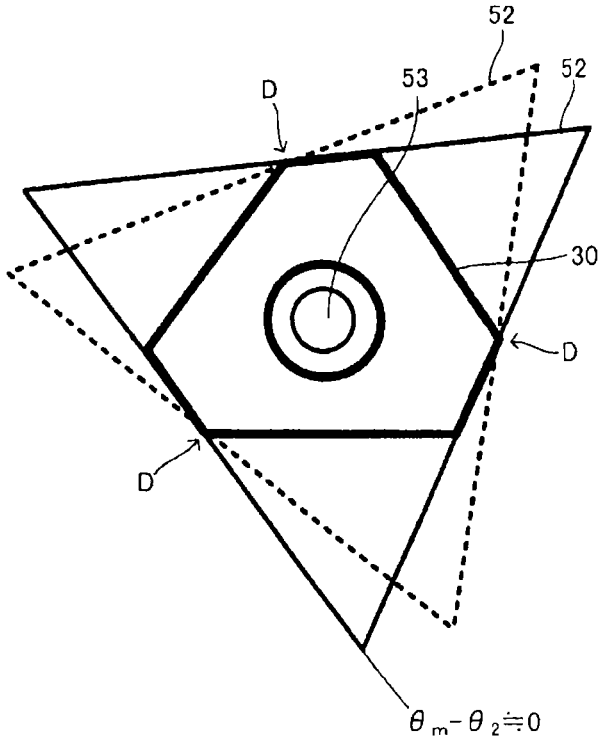
FIG. 14A is a diagram illustrating a state without applying a correction angle $\theta_1$.
Figure 14B:
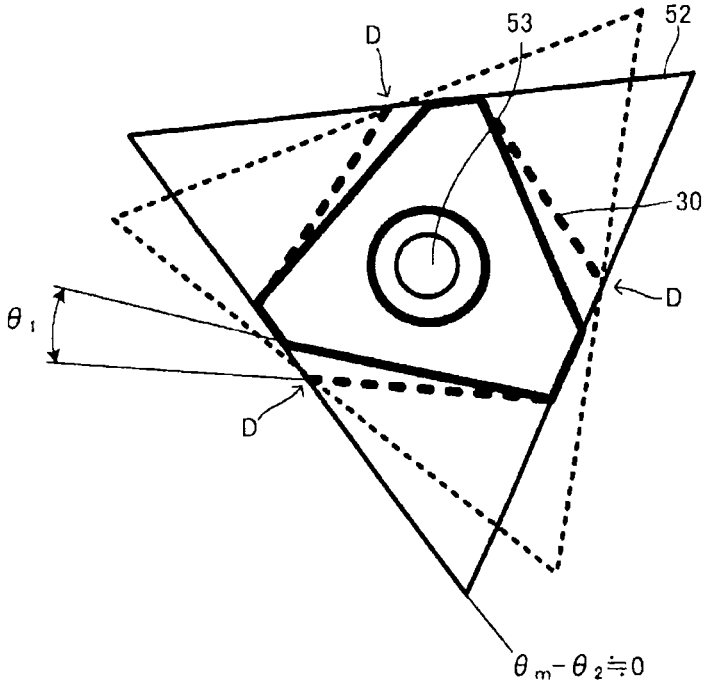
FIG. 14B is a diagram illustrating a correction angle $\theta_1$.

FIGS. 13A, 13B, 14A and 14B are diagrams for explanation relating to correction. FIGS. 13A and 13B are diagrams to explain one correction, in which FIG. 13A is a diagram before applying correction and seen from the same view point as that of FIG. 12, and FIG. 13B is a diagram to explain an idea regarding the correction and seen from the same view point as that of FIG. 13A. FIGS. 14A and 14B are diagrams to explain another correction, in which FIG. 14A is a diagram before applying correction and seen from the same view point as that of FIG. 12, and FIG. 14B is a diagram to explain an idea regarding the correction and seen from the same view point as that of FIG. 14A.

The one correction will be described hereinafter. One example in the case that the one correction is preferable to be applied is shown in FIG. 13A. That is, in the case, it is possible to transmit the rotational driving force and strength of the bearing member is enough. However, the area of the contact parts of the bearing member and the recessed portion is reduced, and thus the force is concentrated, resulting in possibility of flaws and dents. In this case, a correction angle $\theta_2$ is subtracted from the angle $\theta_m$, where $\theta_m$ is the angle before applying the correction.

As can be seen from FIG. 13B, with this correction, $L_c$ can be larger, and therefore flaws and dents can be suppressed.

Meanwhile, there is a situation that the value $\theta_m$ becomes negative before applying the correction, contrary to FIG. 13A. In such a case, a vertex denoted as "B" in FIG. 13A contacts with a side wall of the recessed portion 52, while a vertex denoted as "C", which should contact with the side wall of the recessed portion 52, does not contact with the side wall of the recessed portion 52. For this situation, a correction angle $\theta_2$ having a minus value is subtracted from the angle $\theta_m$ which is before applying the correction. That is, the angle $\theta_m$ should be larger in this case.

The correction angle $\theta_2$ should be applied according to the following criteria. When the above mentioned $R_{1p}/R_{1h}$ is 0.85 to 0.93, $\theta_2$ is 0.1° to 10°. When $R_{1p}/R_{1h}$ is 0.96 to 1.07, $\theta_2$ is −0.1° to −10°.

The volume of the bearing member 30 is increased when $\theta_2$ is positive, while the volume of the bearing member 30 is decreased when $\theta_2$ is negative. When corrected within the range, a surface of the bearing member to transmit the rotational driving force and a surface of the recessed portion to transmit the rotational driving force lineally contact with each other, that is, $L_c$ becomes longer, which results in flaws and dents being suppressed.

Meanwhile, another correction will be described hereinafter.

A triangle formed at the bottom of the recessed portion 52 is also shown by broken lines in FIG. 14A. In this example, $\theta_m-\theta_2$ becomes roughly 0 by applying the above mentioned correction $\theta_2$, which results in securing large $L_c$. On the other hand, as indicated by "D" in FIG. 14A, a corner portion which does not transmit the rotational driving force among the bearing member 30 contacts (interferes) with a side wall of the recessed portion 52 at a portion, which is a cross section point where, in a planar view, the opening side end portion and the bottom side end portion intersect. This portion is a curved surface as this portion is formed by a continuously twisted triangle; therefore interferes tend to occur.

Under this circumstance, contact (interfere) can be avoided by setting the correction angle $\theta_1$ as shown in FIG. 14B, such that an inclined angle of a surface of the bearing member 30 where interfere occurs is corrected. Here, the inclined angle among the hexagonal cross section is defined as an angle of a side which does not contribute to transmit the rotational driving force, that is, a side which does not belong to a side forming $L_c$, to a side which contributes to transmit the rotational driving force.

The correction angle $\theta_1$ is preferable to be applied according to the following criteria. When the above mentioned $R_{1p}/R_{1h}$ is 0.85 to 0.93, $\theta_1$ is 0.1° to 10°. By applying this, the corner portion which does not transmit the rotational driving force among the bearing member can be avoided to contact with the side wall of the recessed portion to interfere with each other. which makes it possible to smoothly engage to and disengage from each other. Here, the fact that $\theta_1$ is positive means that the angle is set so that the above mentioned corner portion which does not transmit the rotational driving force before applying the correction becomes further from the point "D".

In the above description, a combination where another correction ($\theta_1$) is conducted to the configuration caused by the one correction ($\theta_2$) is explained. However, the configuration of FIG. 14A may be realized regardless of whether one correction is applied or not. In such a situation, another correction ($\theta_1$) may be applied independently of the one correction. In addition, another correction may not be necessary when an appropriate configuration is achieved by applying one correction.

In the above-described configuration, the rotational driving force is sufficiently transmitted from the apparatus body to the photosensitive drum, attachment and detachment between the apparatus body and the photosensitive drum unit is smoothly performed, and productivity of the end portion member is excellent. In addition, when the rotational driving force is transmitted, it is possible to increase an effect of minimizing deformation by flaws and dents of the driving shaft and the bearing member.

Next, the manipulation and operation of the image forming apparatus 1 described above will be described.

In order to mount the process cartridge 3 to the apparatus body 2, as illustrated in FIG. 1, the process cartridge 3 is inserted into the apparatus body 2 according to a predetermined guide. At this time, the driving shaft 51 of the apparatus body 2 is in an attitude of being evacuated from the movement path of the process cartridge 3.

After the process cartridge 3 is put in the apparatus body 2 at a predetermined position thereof, along with an operation of closing the lid of the apparatus body 2 or by another operation, the driving shaft 51 is moved toward the process cartridge 3 as illustrated in FIG. 10, and the bearing member 30 is inserted into the recessed portion 52 of the driving shaft 51 as illustrated in FIG. 12 to coaxially engage the two with each other. Accordingly, the rotational driving force from the apparatus body 2 is transmitted to the bearing member 30, the end portion member 20, and the photosensitive drum 11 to be able to be rotated about the axis in synchronization. In addition, the rotational driving force from the apparatus body 2 is transmitted to other constituent members (for example, the charging roller 4) provided in the process cartridge 3 directly or via another member so as to be rotatable.

As described above, while the process cartridge 3 is mounted and the photosensitive drum 11 and the like are in an attitude of being rotatable, the image forming apparatus 1 is operated. In a case where desired text or figures are to be shown in a recording medium, the rotational driving force is applied from the apparatus body 2, the photosensitive drum unit 10 is rotated, and the photosensitive drum 11 is charged by the charging roller 4.

In a state where the photosensitive drum unit 10 is rotated, the photosensitive drum 11 is irradiated with laser light corresponding to image information using various optical members (not illustrated), thereby obtaining an electrostatic latent image based on the corresponding image information. The electrostatic latent image is developed by the developing roller 5.

On the other hand, the recording medium such as paper is set in another part of the apparatus body 2 and is transported to a transfer position by a sending roller, a transporting roller, and the like provided in the apparatus body 2 to be moved along line V of FIG. 5. At the transfer position, transferring means 1*a* is disposed, and by applying a voltage to the transferring means 1*a* as the recording medium passes therethrough, an image is transferred onto the recording medium from the photosensitive drum 11. Thereafter, by applying heat and pressure onto the recording medium, the image is fixed onto the recording medium. In addition, the recording medium on which the image is formed is discharged from the apparatus body 2 by a discharging roll or the like.

In addition, in the photosensitive drum 11, for the next image, the cleaning blade 7 comes into contact with the outer peripheral surface of the photosensitive drum 11 and removes the developer that remains after transfer using its tip end. The developer scraped off by the cleaning blade 7 is discharged in a well-known manner.

Even from the manipulation or operation of the image forming apparatus 1, there are many occasions of attachment and detachment of the process cartridge, and during the operation of the image forming apparatus 1, the photosensitive drum 11 repeats rotating and stopping. Therefore, it can be seen that the photosensitive drum 11 is under the severe conditions of a high burden and presence of charging and heating processes and the like. According to the invention, by the above-described form, it is possible to ensure sufficient rotation precision in addition to the basic function of appropriately transmitting the rotational driving force. In addition, since the bearing member 30 has no twisted shape or an undercut portion, attachment and detachment between the recessed portion 52 and the bearing member 30 is easily performed.

Moreover, from the viewpoint of production of the bearing member 30, since no twisted shape or undercut portion is present, filling and releasing of a material in and from a mold are enhanced, and thus the enhancement in productivity is achieved. In addition, since a slide core and a rotating mechanism of a frame are unnecessary, it is possible to simplify the configuration of the mold.

Figure 15A:
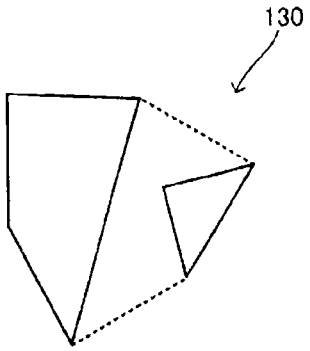
FIG. 15A is a front view and FIG. 15B is a perspective view of a bearing member 130 of a modification example.
Figure 16A:
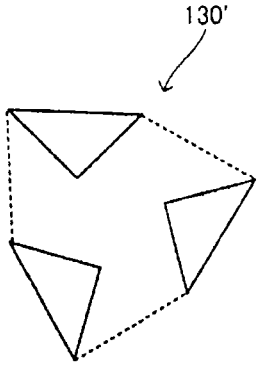
FIG. 16A is a front view and FIG. 16B is a perspective view of a bearing member 130' of a modification example.
Figure 15B:
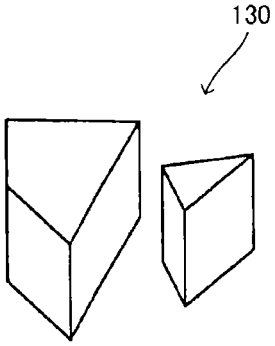
Figure 16B:
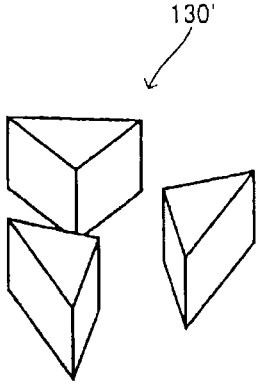

FIGS. 15A and 15B are diagrams illustrating a bearing member 130 included in a modification example, in which FIG. 15A is a front view and FIG. 15B is a perspective view. FIGS. 16A and 16B are diagrams illustrating a bearing member 130' included in a modification example, in which FIG. 16A is a front view and FIG. 16B is a perspective view.

The bearing members 130 and 130' are examples in which the bearing member is divided into a plurality of sections. According to this, by removing other parts rather than the surfaces that transmit the rotational force, unnecessary contact of the bearing member to the recessed portion can be avoided.

In the example where the bearing member is divided into a plurality of sections, a profile (a hexagonal shape) of the bearing member can be defined by using auxiliary lines as shown by broken lines in FIGS. 15A to 16B.

Figure 17A:
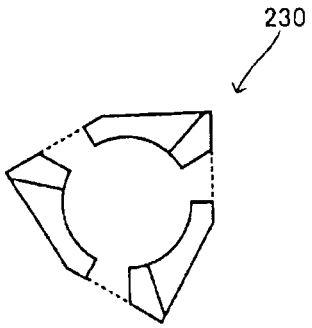
FIG. 17A is a front view and FIG. 17B is a perspective view of a bearing member 230 of a modification example.
Figure 18A:
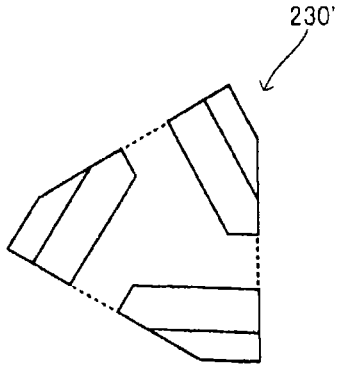
FIG. 18A is a front view and FIG. 18B is a perspective view of a bearing member 230' of a modification example.
Figure 17B:
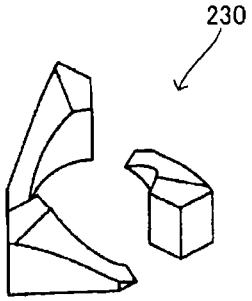
Figure 18B:
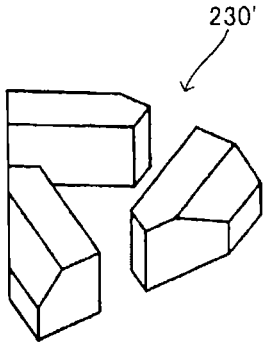

FIGS. 17A and 17B are diagrams illustrating a bearing member 230 included in a modification example, in which FIG. 17A is a front view and FIG. 17B is a perspective view. FIGS. 18A and 18B are diagrams illustrating a bearing member 230' included in a modification example, in which FIG. 18A is a front view and FIG. 18B is a perspective view.

The bearing members 230 and 230' are examples in which chamfered portions (tapered portions) are provided at the edge portions of the bearing member. According to this, by removing other parts rather than the surfaces that transmit the rotational force, unnecessary contact of the bearing member to the recessed portion can also be avoided.

In this example, the bearing member is also divided into a plurality of sections, a profile (a hexagonal shape) of the bearing member can be defined by using auxiliary lines as shown by broken lines in FIGS. 17A to 18B.

Figure 19A:
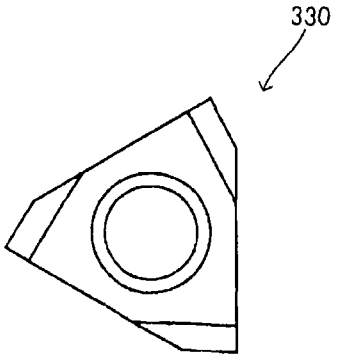
FIG. 19A is a front view and FIG. 19B is a perspective view of a bearing member 330 of a modification example.
Figure 19B:
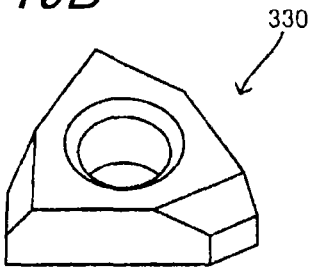
Figure 20A:
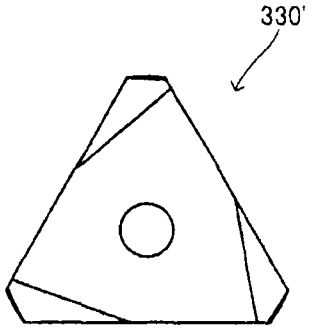
FIG. 20A is a front view and FIG. 20B is a perspective view of a bearing member 330' of a modification example.
Figure 20B:
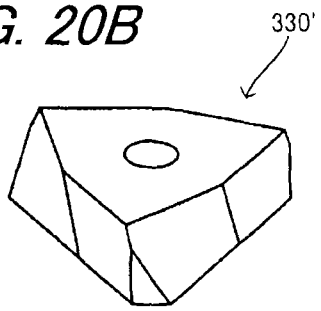

FIGS. 19A and 19B are diagrams illustrating a bearing member 330 included in a modification example, in which FIG. 19A is a front view and FIG. 19B is a perspective view. FIGS. 20A and 20B are diagrams illustrating a bearing member 330' included in a modification example, in which FIG. 20A is a front view and FIG. 20B is a perspective view.

The bearing members 330 and 330' are examples in which free curved surfaces are provided in the bearing member as necessary. According to this, by removing other parts rather than the surfaces that transmit the rotational force, unnecessary contact of the bearing member to the recessed portion can also be avoided.

Hereinafter, a more specific form is exemplified. The end portion member was molded from a polyacetal resin with an outside diameter of 28.5 mm, and the shapes of the recessed portion and the bearing member were changed. Each shape is shown in Table 1. Each item described in Table 1 is as described hereinabove.

TABLE 1

| | Parameters of recessed portion | | | | | Parameters of bearing member | | | | | | $R_{2p}$ − | | | Correction | | Interference |
|---|---|---|---|---|---|---|---|---|---|---|---|---|---|---|---|---|---|
| | $R_{1h}$ (mm) | $R_{2h}$ (mm) | $R_{3h}$ (mm) | $h_h$ (mm) | $\theta_a$ (°) | $R_{1p}$ (mm) | $R_{2p}$ (mm) | $R_{3p}$ (mm) | $h_p$ (mm) | $\theta_p$ (°) | $R_{1p}/R_{1h}$ | $L_c$ (mm) | $R_{3h}$ (mm) | $\theta_m$ (°) | $\theta_1$ (°) | $\theta_2$ (°) | amount ($mm^3$) |
| 1 | 20.99 | 17.49 | 10.81 | 4.2 | 30.0 | 19.3 | 13.65 | 10.36 | 4.5 | 30 | 0.92 | 3.1 | 2.8 | 2.3 | None | 3° | 0 |
| 2 | 20.1 | 16.4 | 11 | 4.2 | 32.0 | 19.3 | 13.65 | 10.36 | 4.5 | 30 | 0.96 | 2.4 | 2.7 | 0.6 | None | 3° | 0 |
| 3 | 19.3 | 17.2 | 9.65 | 4.1 | 28.0 | 18 | 12.73 | 9.54 | 4.5 | 30 | 0.93 | 5.4 | 3.1 | 2.0 | None | 2° | 0 |
| 4 | 19 | 17.4 | 10.8 | 4.2 | 29.0 | 18.5 | 13.01 | 9.59 | 4.5 | 30.7 | 0.97 | 1.9 | 2.2 | 0.6 | None | 1° | 0 |
| 5 | 15.2 | 11.3 | 7.6 | 4.2 | 28.0 | 14 | 9.9 | 7.42 | 4.5 | 30 | 0.92 | 4.2 | 2.3 | 3.1 | None | 2° | 0 |
| 6 | 20.21 | 17.39 | 10.09 | 4.2 | 27.0 | 18.6 | 13.15 | 9.98 | 4.6 | 30 | 0.92 | 5.4 | 3.1 | 2.2 | None | 3° | 0 |
| 7 | 19.2 | 17.4 | 11 | 9.5 | 29.1 | 18.6 | 13.15 | 9.98 | 4.6 | 30 | 0.97 | 1.9 | 2.2 | 1.9 | None | 3° | 0 |
| 8 | 13.99 | 11.61 | 6.99 | 3.2 | 20.0 | 12 | 8.64 | 6.18 | 3.5 | 28 | 0.86 | 2.5 | 1.7 | 10.1 | None | None | 0 |
| 9 | 13.99 | 11.61 | 6.99 | 3.2 | 20.0 | 13 | 9.36 | 6.7 | 3.5 | 28 | 0.93 | 4.2 | 2.4 | 3.1 | None | None | 0 |
| 10 | 13.99 | 11.61 | 6.99 | 3.2 | 20.0 | 12.5 | 9 | 6.87 | 3.5 | 28 | 0.89 | 3.5 | 2.0 | 1.6 | None | 5° | 0 |
| 11 | 13.99 | 11.61 | 6.99 | 3.2 | 20.0 | 13.5 | 9.72 | 6.96 | 3.5 | 28 | 0.96 | 4.3 | 2.7 | 2.1 | None | None | 0.006 |
| 12 | 13.99 | 11.61 | 6.99 | 3.2 | 20.0 | 14 | 10.08 | 7.21 | 3.5 | 28 | 1.00 | 4.5 | 3.1 | 0.3 | None | None | 0.701 |
| 13 | 1.99 | 11.61 | 6.99 | 3.2 | 20.0 | 12.25 | 8.82 | 6.75 | 3.5 | 28 | 0.88 | 3.3 | 1.8 | 2.5 | None | 6° | 0 |
| 14 | 13.99 | 11.61 | 6.99 | 3.2 | 20.0 | 13 | 9.36 | 6.95 | 3.5 | 28 | 0.93 | 3.2 | 2.4 | 0.2 | −3° | 4° | 0 |
| 15 | 15.8 | 11.4 | 9 | 4.7 | 36.6 | 14.3 | 9.75 | 8.21 | 4.2 | 34.36 | 0.91 | 0.7 | 0.8 | 1.0 | None | 7° | 0 |
| 16 | 15.8 | 11.4 | 9 | 4.7 | 36.6 | 15.3 | 10.43 | 8.1 | 4.2 | 34.36 | 0.97 | 1.3 | 1.4 | 1.1 | None | 1° | 0 |
| 17 | 15.8 | 11.4 | 9 | 4.7 | 36.6 | 15.8 | 10.77 | 8.27 | 4.2 | 34.36 | 1.00 | 1.5 | 1.8 | 0.0 | None | None | 0.051 |
| 18 | 15.8 | 11.4 | 9 | 4.7 | 32.3 | 16.3 | 11.11 | 8.36 | 3.7 | 34.36 | 1.03 | 1.8 | 2.1 | 0.1 | None | −2° | 0.063 |
| 19 | 19.3 | 16.4 | 10.9 | 4.2 | 29.0 | 18.7 | 13.22 | 9.79 | 4.5 | 30 | 0.97 | 2.0 | 2.3 | 0.7 | None | 1° | 0 |
| 20 | 19.1 | 16.4 | 11 | 9.3 | 27.1 | 18.6 | 13.15 | 9.3 | 4.2 | 30 | 0.97 | 1.8 | 2.2 | 0.6 | None | 1° | 0 |
| 21 | 19.1 | 16.4 | 11 | 9.3 | 27.1 | 19.1 | 13.51 | 9.89 | 4.2 | 30 | 1.00 | 2.1 | 2.5 | 0.0 | None | None | 0 |
| 22 | 19.1 | 16.4 | 11 | 9.3 | 27.1 | 19.6 | 13.86 | 9.95 | 4.2 | 30 | 1.03 | 2.3 | 2.9 | 0.6 | None | −2° | 0.135 |
| 23 | 19.1 | 16.4 | 11 | 9.3 | 23.9 | 20.1 | 14.21 | 10.12 | 3.7 | 30 | 1.05 | 2.5 | 3.2 | 0.2 | None | −3° | 0.048 |
| 24 | 17.5 | 13.08 | 9.5 | 3.1 | 24.0 | 15.6 | 11.23 | 8.8 | 3.5 | 28 | 0.89 | 1.7 | 1.7 | 0.1 | None | 7° | 0 |
| 25 | 17.5 | 13.08 | 9.5 | 3.1 | 24.0 | 16.1 | 11.59 | 8.73 | 3.5 | 28 | 0.92 | 2.0 | 2.1 | 1.0 | None | 4° | 0 |
| 26 | 17.5 | 13.08 | 9.5 | 3.1 | 24.0 | 17 | 12.24 | 8.86 | 3.5 | 28 | 0.97 | 2.4 | 2.7 | 0.6 | None | 1° | 0 |
| 27 | 17.5 | 13.08 | 9.5 | 3.1 | 24.0 | 17.5 | 12.6 | 9.02 | 3.5 | 28 | 1.00 | 2.7 | 3.1 | 0.3 | None | None | 0 |
| 28 | 20.98 | 17.8 | 10.49 | 4.2 | 29.0 | 19.5 | 13.79 | 10.46 | 4.5 | 30 | 0.93 | 4.4 | 3.3 | 0.6 | None | 3° | 0 |

As described above, according to the first embodiment, the end portion member including the bearing member which satisfies the regulations of the invention can be appropriately manufactured.

In addition, by designing the members as described above, the rotational driving force is reliably transmitted, and flaws or dents of the recessed portion on the apparatus body side by the end portion member can be minimized.

Second Embodiment

Hereinafter, an end portion member according to a second embodiment will be described using the drawings. In addition, like elements as those of the first embodiment are denoted by like reference numerals, and description thereof will be omitted.

As illustrated in FIGS. 2A and 2B, the recessed portion 52 has an opening formed at the end surface of the driving shaft 51 and has a predetermined capacity enclosed between the opening and the bottom surface of the recessed portion 52 by the side walls thereof. In addition, the cross-sectional area of each cross-section of the recessed portion 52, which is orthogonal to the direction in which the axis of the driving shaft 51 extends (that is, orthogonal to the depth direction of the recessed portion 52) can be defined. Regarding the cross-sectional area and the capacity at this time, a protrusion 63 is not considered.

Figure 21:
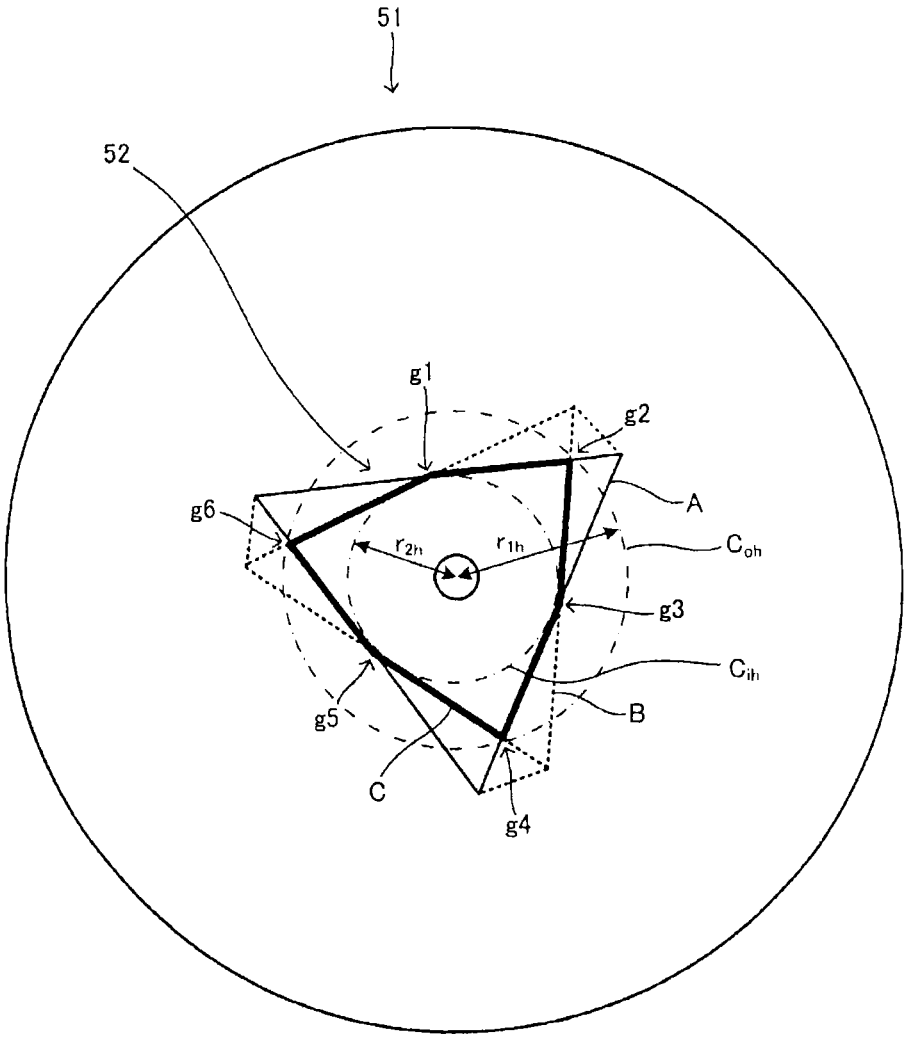
FIG. 21 is a diagram illustrating the shape of the recessed portion.

As can be seen from FIG. 2B, when the recessed portion 52 is seen through from the front in the axial direction, a triangle (indicated by full lines) formed at the opening of the recessed portion 52 and a triangle (indicated by broken lines) formed at the bottom of the recessed portion 52 are seen as two overlapping triangles rotated about the axis. From this form, the following characteristics are defined. FIG. 21 illustrates a diagram for explanation.

In FIG. 21, the triangle formed at the opening of the recessed portion 52 is denoted by reference numeral A, and the triangle formed at the bottom of the recessed portion 52 is denoted by reference numeral B. Here, when the recessed portion 52 is viewed from the viewpoint of FIG. 21, on the inside enclosed by the two triangles A and B, a hexagon C having the vertices g1 to g6 is formed (the hexagon C is indicated by a thick line in FIG. 21). In addition, the circumscribed circle of the hexagon C is denoted by $C_{oh}$, the inscribed circle of the hexagon C is denoted by $C_{ih}$, the radius of $C_{oh}$ is denoted by $r_{1h}$, and the radius of $C_{ih}$ is denoted by $r_{2h}$.

As described later, since the radius $r_{2h}$ has a relationship with the predetermined shape of the bearing member 30, a rotational force can be reliably transmitted.

Here, an example in which the recessed portion 52 is a triangle is described. However, a polygon made on the basis of a triangle and by slightly cutting out the vertices of the triangle may also be employed.

Figure 22:
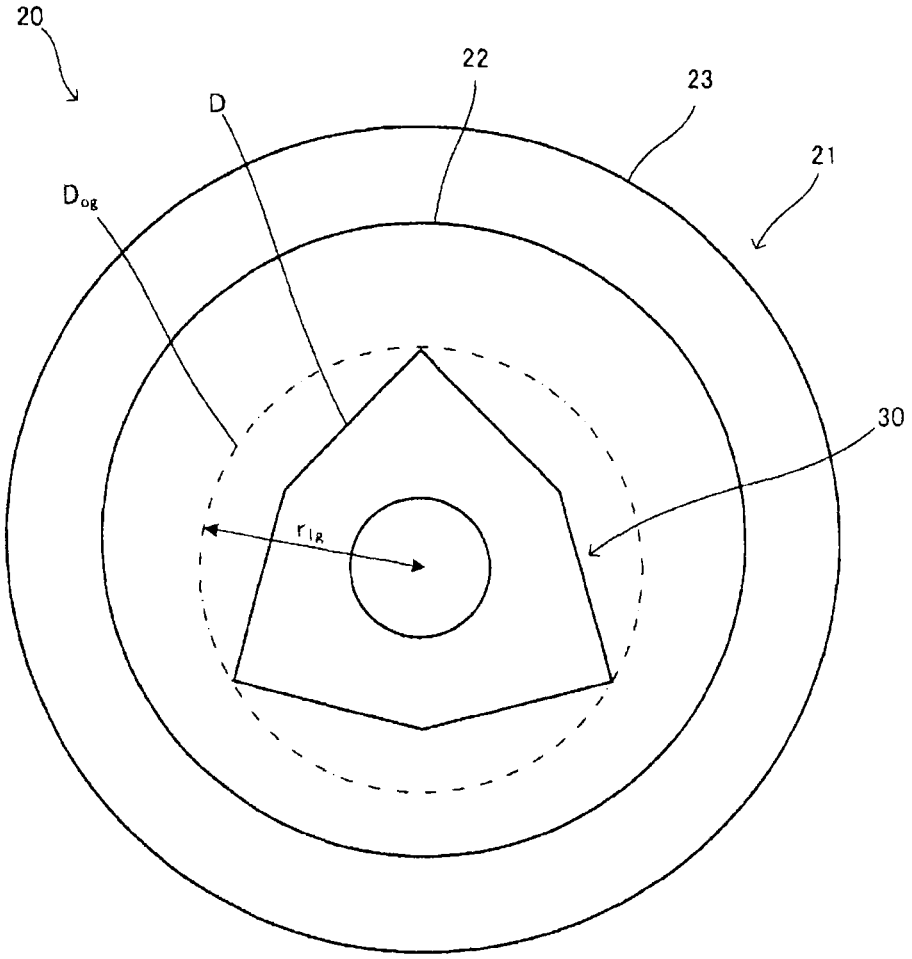
FIG. 22 is a diagram illustrating the shape of the bearing member.

As can be seen from FIGS. 8A and 8B, the bearing member 30 is a cylindrical body provided to protrude from the bottom of the cylindrical body 22 in the axial direction, and has a hexagonal outer peripheral shape in a cross-section orthogonal to the axial direction and a circular inner peripheral shape. FIG. 22 illustrates a diagram illustrating the shape of the bearing member 30 by enlarging FIG. 8A. The bearing member 30 has a shape of a hexagon D from the viewpoint of FIG. 22 as described above. Here, the circumscribed circle of the hexagon D is denoted by $D_{og}$, and the radius thereof is denoted by $r_{1g}$. In addition, the radius $r_{2h}$ of the inscribed circle $C_{ih}$ of the hexagon C in the recessed portion 52 described with reference to FIG. 21 and the radius $r_{1g}$ of the circumscribed circle $D_{og}$ of the corresponding hexagon D satisfy the relationship of the following expression (1).

$$r_{1g}-r_{2h}>0 \quad (1)$$

Since the recessed portion 52 of the driving shaft 51 and the bearing member 30 have shapes that satisfy the relationship as shown in the expression (1), the rotational driving force from the driving shaft 51 can be reliably transmitted to the bearing member 30, the end portion member 20 provided with the bearing member 30, and the photosensitive drum 11 without idling.

In addition, the bearing member 30 does not have a so-called twisted shape in the axial direction and does not have an undercut part. That is, regarding the undercut part, when the bearing member 30 is viewed in the axial direction from the end portion on the root side (the end portion on the body 21 side) of the bearing member 30 (when the bearing member 30 is viewed from the rear surface side which is on the opposite side to that of FIG. 8A), other parts of the bearing member 30 are not seen.

Accordingly, filling and releasing of a material in and from a mold are enhanced when the bearing member 30 (the end portion member 20) is formed, and thus productivity is enhanced. In addition, a slide core and a rotating mechanism of a frame are unnecessary, and thus it is possible to simplify the configuration of the mold itself.

Moreover, the bearing member 30 has the following form with respect to the recessed portion 52 provided in the driving shaft 51 of the apparatus body 2 with which the bearing member 30 is engaged. That is, while the bearing member 30 is in an attitude of being inserted into the recessed portion 52 of the driving shaft 51, at at least one point of parts where the bearing member 30 comes into contact with the side surfaces of the recessed portion 52 to transmit the rotational force, in a cross-section orthogonal to the direction in which the axis extends, a cross-sectional area occupancy ratio $A_R$ which is a degree of the cross-section of the bearing member 30 that occupies the cross-section of the recessed portion 52 is 15% or higher and 75% or less. Preferably, the cross-sectional area occupancy ratio is 20% or higher and 70% or less.

Figure 23A:
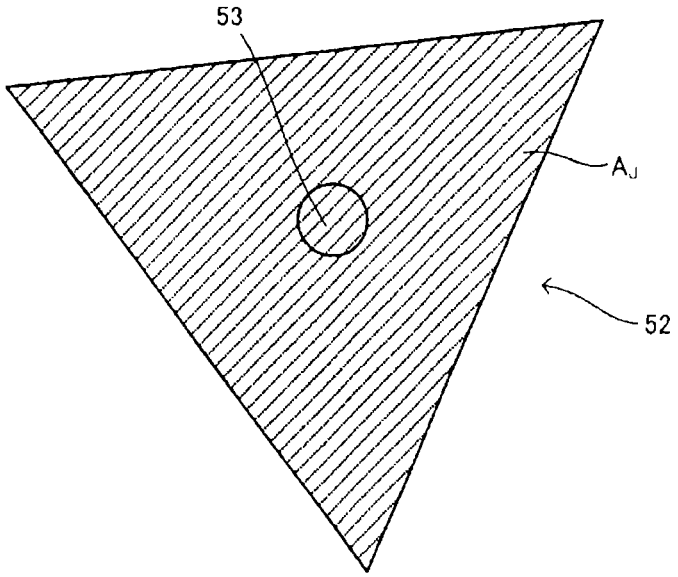
FIG. 23A is a diagram illustrating a cross-section area $A_J$ for obtaining a cross-sectional area occupancy ratio.
Figure 23B:
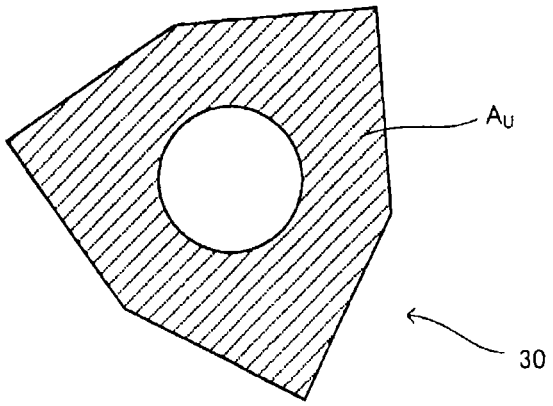
FIG. 23B is a diagram illustrating a cross-section area $A_U$ for obtaining the cross-sectional area occupancy ratio.

Here, the cross-sectional area occupancy ratio can be obtained as follows. FIGS. 23A and 23B illustrate a diagram for explanation. As described later, by inserting the bearing member 30 into the recessed portion 52, the bearing member 30 is engaged with the driving shaft 51. In addition, when the driving shaft 51 is rotated, at least a portion of the side walls of the recessed portion 52 comes into contact with the outer peripheral portion of the bearing member 30, and accordingly the rotational force is transmitted to the bearing member 30. Therefore, the rotational force is transmitted at the contact portion. An example of the contact portion is described later (see FIGS. 23 and 26).

At this time, the cross-sectional area of the cross-section of the recessed portion 52 which is orthogonal to the direction in which the axis extends at any of the contact parts is denoted by $A_J$. In FIG. 23A, the cross-section of the recessed portion 52 is illustrated. The cross-sectional area $A_J$ includes the entire inside enclosed by the side walls in the corresponding cross-section without considering the protrusion 53 as indicated by a hatched part in FIG. 23A.

On the other hand, the cross-sectional area of the cross-section of the bearing member 30 which is orthogonal to the direction in which the axis extends at a position corresponding to the cross-section of the cross-sectional area $A_J$ among the contact parts is denoted by $A_U$. In FIG. 23B, the cross-section of the bearing member 30 is illustrated. As indicated by a hatched part in FIG. 23B, in a case where a hollow portion is present, considering this, the cross-sectional area $A_U$ does not include the hollow portion.

From $A_J$ and $A_U$ defined as above, the cross-sectional area occupancy ratio $A_R$ can be obtained by the following expression.

$$A_R=(A_U/A_J)\times 100\% \quad (2)$$

When the cross-sectional area occupancy ratio $A_R$ is less than 15%, there is a concern that the bearing member 30 may not be engaged with the recessed portion 52 but be idling. In addition, even when the engagement is achieved, there is a possibility that the engaged parts may not bear the rotational torque but be damaged. In this case, the rigidity of the bearing member 30 in the rotational direction is insufficient, and thus the shaft is twisted. Therefore, there is a concern that the axis core may be deviated and thus the transmission precision of the rotational force may be degraded.

On the other hand, when the cross-sectional area occupancy ratio $A_R$ is higher than 75%, although the strength of the bearing member 30 itself is enhanced, the occupancy ratio of the bearing member 30 is too high when the bearing member 30 is engaged with the recessed portion 52, and thus there is a possibility that engagement and separation may not be smoothly performed.

In addition to the cross-sectional area occupancy ratio $A_R$ or separately from the cross-sectional area occupancy ratio $A_R$, the bearing member 30 may be formed so that the volume occupancy ratio which is a degree of volume of the bearing member 30 inserted with respect to the capacity of the recessed portion 52 provided in the driving shaft 51 of the apparatus body 2 with which the bearing member 30 is engaged is 20% or higher and 70% or less. Preferably, the volume occupancy ratio is 30% or higher and 70% or less.

Here, the volume occupancy ratio $\theta_V$ can be obtained as follows. That is, assuming that the volume related to a part of the bearing member 30 inserted into the recessed portion 52 is V and the capacity of the recessed portion 52 is W, the volume occupancy ratio $\theta_V$ can be obtained by the following expression (3).

$$O_V=(V/W)\times 100\% \quad (3)$$

Here, when a hollow portion is present in the bearing member 30, considering this, the volume V excludes the hollow portion. On the other hand, regarding W, the presence of the protrusion is not considered as described above.

When the volume occupancy ratio $\theta_V$ is less than 20%, there is a concern that the bearing member 30 may not be engaged with the recessed portion 52 but be idling. In addition, even when the engagement is achieved, there is a possibility that the engaged parts may not bear the rotational torque but be damaged. In this case, the rigidity of the bearing member 30 in the rotational direction is insufficient, and thus the shaft is twisted. Therefore, there is a concern that the axis core may be deviated and thus the transmission precision of the rotational force may be degraded.

On the other hand, when the volume occupancy ratio $\theta_V$ is higher than 80%, although the strength of the bearing member 30 itself is enhanced, the occupancy ratio of the bearing member 30 is too high when the bearing member 30 is engaged with the recessed portion 52, and thus there is a possibility that engagement and separation may not be smoothly performed.

The inner peripheral shape of the bearing member 30 does not necessarily have a circular cross-section and may have any shape as long as it can be engaged with the recessed portion 52. In this form, the bearing member 30 has the cylindrical body but may also have a solid columnar shape.

It is preferable that the end portion member 20 be formed of a crystalline resin. The crystalline resin has a good flow when being subjected to injection molding using a mold, and thus has good molding workability. In addition, the crystalline resin is crystallized and solidified even when it is not cooled to a glass-transition point and thus can be released from the mold. Therefore, it is possible to significantly enhance productivity. In addition, the crystalline resin has excellent heat resistance, solvent resistance, oil resistance, and grease resistance, has good friction and wear resistance and sliability, and is preferable as a material applied to the end portion member even from the viewpoint of rigidity and hardness.

Examples of the crystalline resin include polyethylene, polypropylene, polyamide, polyacetal, polyethylene terephthalate, polybutylene terephthalate, methylpentene, polyphenylene sulfide, polyether ether ketone, polytetrafluoroethylene, and nylon.

Among these, from the viewpoint of molding workability, it is preferable that a polyacetal-based resin be used.

In addition, from the viewpoint of increasing strength, glass fiber, carbon fiber, or the like may be filled.

A configuration in which the photosensitive drum 11 is electrically connected by providing a conductive plate (earthing plate) on the end portion member side provided with the bearing member 30 and causing the conductive plate to come into contact with an electrode provided on the driving shaft 51 side of the apparatus body 2 is possible. At this time, a method of forming the bearing member 30 from a conductive material, a method of exposing the conductive plate to the inner periphery of the bearing member 30, or the like may be employed.

Figure 24:
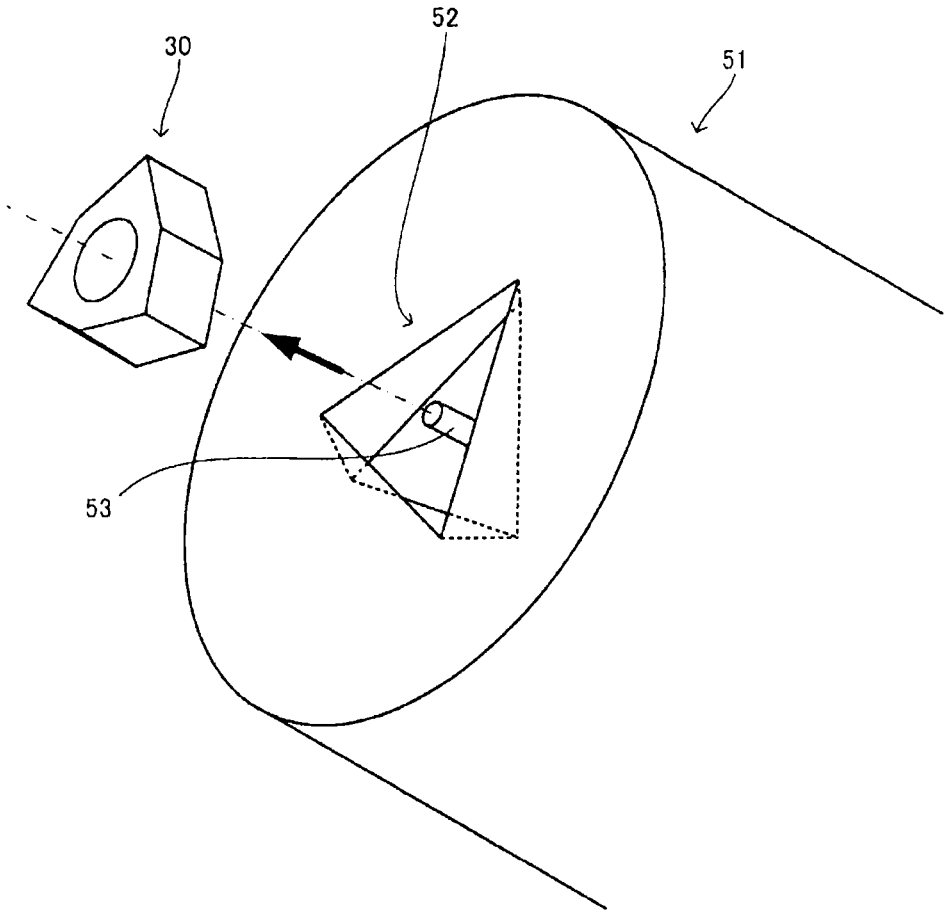
FIG. 24 is a perspective view illustrating the engagement between the bearing member and the recessed portion of the driving shaft.
Figure 25:
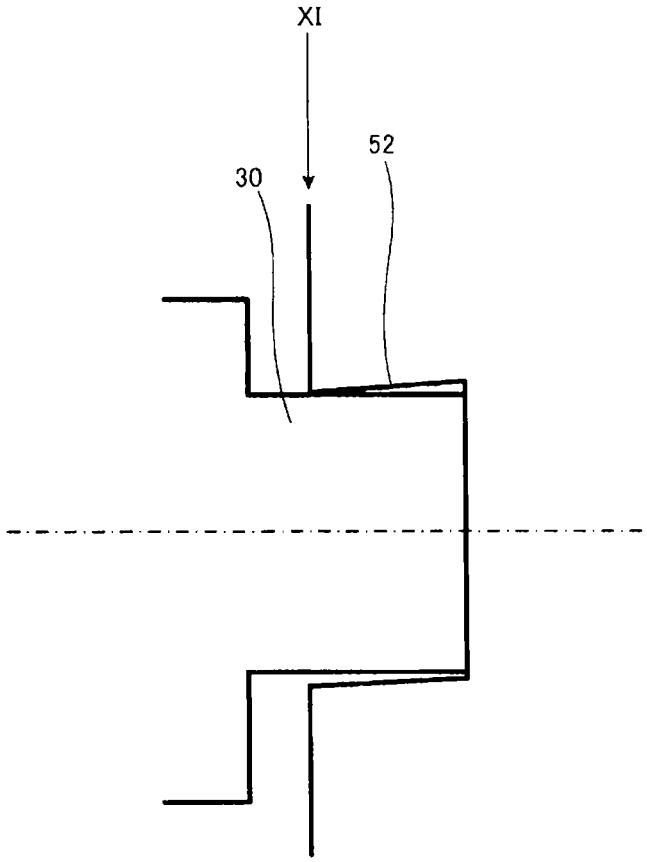
FIG. 25 is a cross-sectional view illustrating the engagement between the bearing member and the recessed portion of the driving shaft in a direction along the axis.
Figure 26:
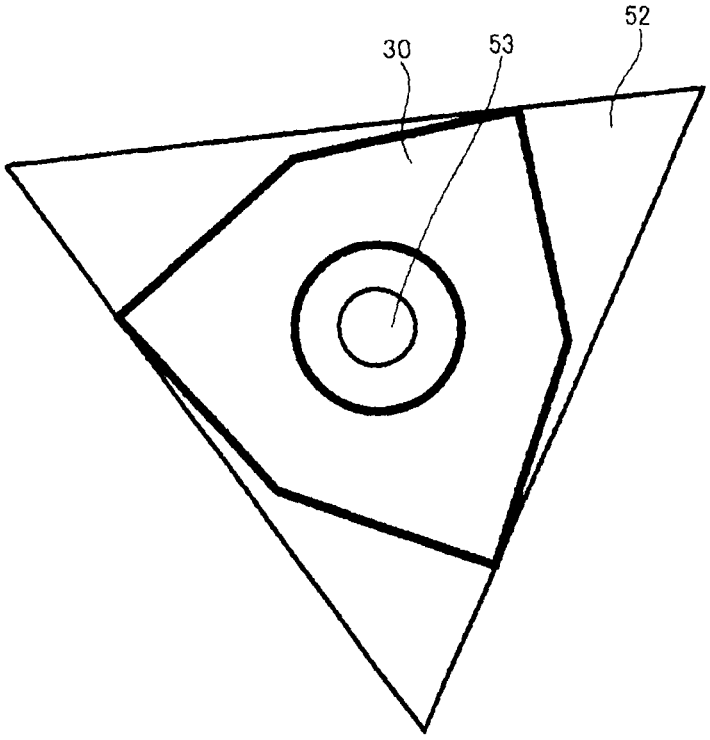
FIG. 26 is a cross-sectional view orthogonal to a direction in which the axis extends at a part where the recessed portion and the bearing member come into contact with each other to transmit a rotational force.

FIGS. 24 to 26 illustrate schematic diagrams of a mode in which the bearing member 30 provided in the photosensitive drum unit 10 and the recessed portion 52 of the driving shaft 51 provided in the apparatus body 2 are engaged with each other. FIG. 24 is a perspective view schematically illustrating a figure of a procedure of the engagement. FIG. 25 is a diagram schematically illustrating a cross-section in the axial direction in an attitude of the recessed portion 52 and the bearing member 30 being engaged with each other. FIG. 26 is a cross-sectional view of a part indicated by XI in FIG. 25, illustrates parts where the side walls of the recessed portion 52 come into contact with the outer peripheral surface of the bearing member 30 in the attitude of the recessed portion 52 and the bearing member 30 being engaged with each other, and is a cross-sectional view orthogonal to the direction in which the axis extends. Therefore, in this cross-section, the cross-sectional area occupancy ratio $A_R$ can be calculated.

As can be seen from FIG. 24, after the process cartridge 3 is mounted to the apparatus body 2, the driving shaft 51 is moved in the axial direction to insert the bearing member 30 into the inside of the recessed portion 52 thereof. In addition, after the insertion, as illustrated in FIGS. 25 and 26, parts or the entirety of at least three surfaces among the outer peripheral surfaces of the hexagon of the bearing member 30 come into contact with parts on the end surface side of the recessed portion 52 (in this form, parts indicated by XI in FIG. 25, and the ridge lines on the opening side of the recessed portion 52), and the two are engaged in an attitude capable of transmitting the rotational driving force about the axis. In this example, these parts are the contact parts by which the above-mentioned cross-sectional area occupancy ratio $A_R$ are to be obtained.

In addition, at this time, the protrusion 53 provided in the recessed portion 52 is inserted into the cylindrical inner space of the bearing member 30.

When the driving shaft 51 and the bearing member 30 are engaged with each other, the driving shaft 51, the bearing member 30, the body 21, and the photosensitive drum 11 are coaxial.

In addition, since the bearing member 30 has no undercut part, during engagement with the recessed portion 52 or during release therefrom in the opposite case, the bearing member 30 is smoothly operated.

Next, the manipulation and operation of the image forming apparatus 1 described above will be described.

In order to mount the process cartridge 3 to the apparatus body 2, as illustrated in FIG. 1, the process cartridge 3 is inserted into the apparatus body 2 according to a predetermined guide. At this time, the driving shaft 51 of the apparatus body 2 is in an attitude of being evacuated from the movement path of the process cartridge 3.

After the process cartridge 3 is put in the apparatus body 2 at a predetermined position thereof, along with an operation of closing the lid of the apparatus body 2 or by another operation, the driving shaft 51 is moved toward the process cartridge 3 as illustrated in FIG. 10, and the bearing member 30 is inserted into the recessed portion 52 of the driving shaft 51 as illustrated in FIGS. 25 and 26 to coaxially engage the two with each other. Accordingly, the rotational driving force from the apparatus body 2 is transmitted to the bearing member 30, the end portion member 20, and the photosensitive drum 11 to be able to be rotated about the axis in synchronization. In addition, the rotational driving force from the apparatus body 2 is transmitted to other constituent members (for example, the charging roller 4) provided in the process cartridge 3 directly or via another member so as to be rotatable.

As described above, while the process cartridge 3 is mounted and the photosensitive drum 11 and the like are in an attitude of being rotatable, the image forming apparatus is operated. In a case where desired text or figures are to be shown in a recording medium, the rotational driving force is applied from the apparatus body 2, the photosensitive drum unit 10 is rotated, and the photosensitive drum 11 is charged by the charging roller 4.

In a state where the photosensitive drum unit 10 is rotated, the photosensitive drum 11 is irradiated with laser light corresponding to image information using various optical members (not illustrated), thereby obtaining an electrostatic latent image based on the corresponding image information. The electrostatic latent image is developed by the developing roller 5.

On the other hand, the recording medium such as paper is set in another part of the apparatus body 2 and is transported to a transfer position by a sending roller, a transporting roller, and the like provided in the apparatus body 2 to be moved along line V of FIG. 5. At the transfer position, the transferring means 1*a* is disposed, and by applying a voltage to the transferring means 1*a* as the recording medium passes therethrough, an image is transferred onto the recording medium from the photosensitive drum 11. Thereafter, by applying heat and pressure onto the recording medium, the image is fixed onto the recording medium. In addition, the recording medium on which the image is formed is discharged from the apparatus body 2 by a discharging roll or the like.

In addition, in the photosensitive drum 11, for the next image, the cleaning blade 7 comes into contact with the outer peripheral surface of the photosensitive drum 11 and removes the developer that remains after transfer using its tip end. The developer scraped off by the cleaning blade 7 is discharged in a well-known manner.

Even from the manipulation or operation of the image forming apparatus, there are many occasions of attachment and detachment of the process cartridge, and during the operation of the image forming apparatus 1, the photosensitive drum 11 repeats rotating and stopping. Therefore, it can be seen that the photosensitive drum 11 is under the severe conditions of a high burden and presence of charging and heating processes and the like. According to the invention, by the above-described form of the bearing member 30, it is possible to ensure sufficient rotation precision due to the cross-sectional area occupancy ratio and/or the volume occupancy ratio and the outer form (the relationship of the expression (1)) of the bearing member 30, in addition to the basic function of appropriately transmitting the rotational driving force. In addition, since the bearing member 30 has no twisted shape or an undercut portion, the attachment and detachment between the recessed portion 52 and the bearing member 30 is easily performed.

Moreover, since the bearing member 30 has no twisted shape or an undercut portion, filling and releasing of a material in and from a mold are enhanced, and thus the enhancement in productivity is achieved. In addition, since a slide core and a rotating mechanism of a frame are unnecessary, it is possible to simplify the configuration of the mold.

Figure 27A:
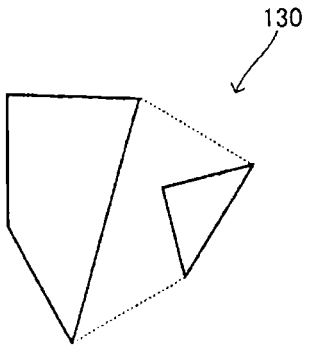
FIG. 27A is a front view and FIG. 27B is a perspective view of a bearing member 130 of a modification example.
Figure 28A:
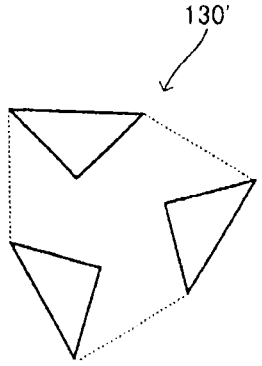
FIG. 28A is a front view and FIG. 28B is a perspective view of a bearing member 130' of a modification example.
Figure 27B:
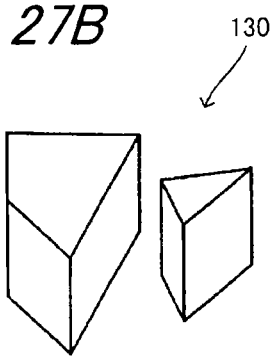
Figure 28B:
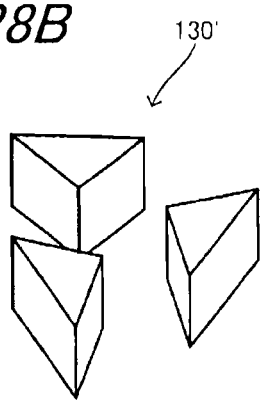

FIGS. 27A and 27B are diagrams illustrating a bearing member 130 included in a modification example, in which FIG. 27A is a front view and FIG. 27B is a perspective view. FIGS. 28A and 28B are diagrams illustrating a bearing member 130' included in a modification example, in which FIG. 28A is a front view and FIG. 28B is a perspective view.

The bearing members 130 and 130' are examples in which the bearing member is divided into a plurality of sections. According to this, by removing other parts rather than the surfaces that transmit the rotational force, unnecessary contact of the bearing member to the recessed portion can be avoided. Even in this case, the cross-sectional area occupancy ratio of any of the parts that transmit the rotational force (parts that come into contact with the recessed portion) can be obtained. In addition, when the hexagon D illustrated in FIG. 22 is specified, as indicated by broken lines of FIGS. 27A to 28B, the hexagon D can be obtained by filling the missing parts with virtual lines.

Figure 29A:
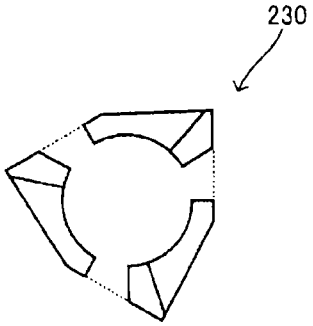
FIG. 29A is a front view and FIG. 29B is a perspective view of a bearing member 230 of a modification example.
Figure 30A:
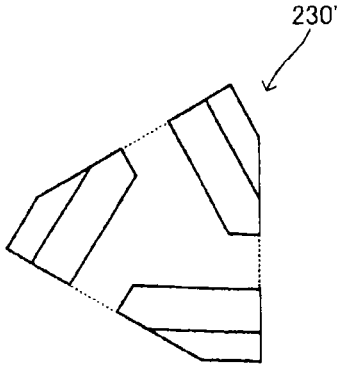
FIG. 30A is a front view and FIG. 30B is a perspective view of a bearing member 230' of a modification example.
Figure 29B:
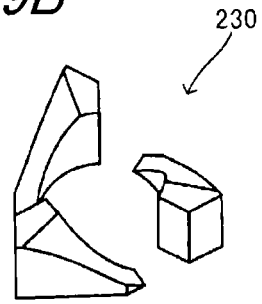
Figure 30B:
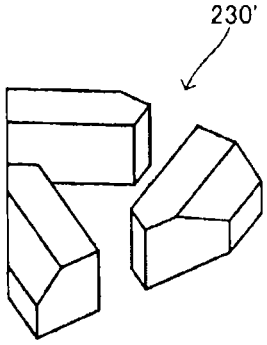

FIGS. 29A and 29B are diagrams illustrating a bearing member 230 included in a modification example, in which FIG. 29A is a front view and FIG. 29B is a perspective view. FIGS. 30A and 30B are diagrams illustrating a bearing member 230' included in a modification example, in which FIG. 30A is a front view and FIG. 30B is a perspective view.

The bearing members 230 and 230' are examples in which chamfered portions (tapered portions) are provided at the edge portions of the bearing member. According to this, by removing other parts rather than the surfaces that transmit the rotational force, unnecessary contact of the bearing member to the recessed portion can also be avoided. Even in this case, the cross-sectional area occupancy ratio of any of the parts that transmit the rotational force (parts that come into contact with the recessed portion) can be obtained. In addition, when the hexagon D illustrated in FIG. 22 is specified, as indicated by broken lines of FIGS. 29A to 30B, the hexagon D can be obtained by filling the missing parts with virtual lines.

Figure 31A:
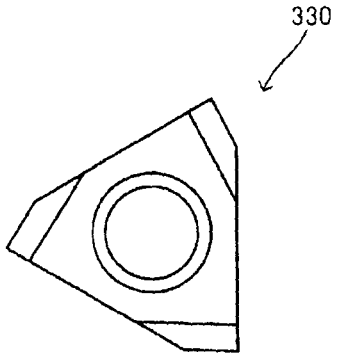
FIG. 31A is a front view and FIG. 31B is a perspective view of a bearing member 330 of a modification example.
Figure 31B:
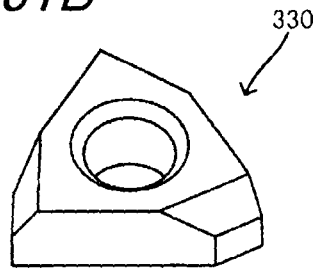
Figure 32A:
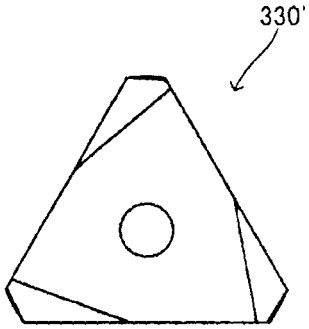
FIG. 32A is a front view and FIG. 32B is a perspective view of a bearing member 330' of a modification example.
Figure 32B:
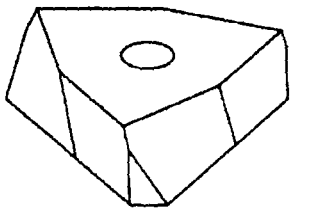

FIGS. 31A and 31B are diagrams illustrating a bearing member 330 included in a modification example, in which FIG. 31A is a front view and FIG. 31B is a perspective view. FIGS. 32A and 32B are diagrams illustrating a bearing member 330' included in a modification example, in which FIG. 32A is a front view and FIG. 32B is a perspective view.

The bearing members 330 and 330' are examples in which free curved surfaces are provided in the bearing member as necessary. According to this, by removing other parts rather than the surfaces that transmit the rotational force, unnecessary contact of the bearing member to the recessed portion can also be avoided. Even in this case, the cross-sectional area occupancy ratio of any of the parts that transmit the rotational force (parts that come into contact with the recessed portion) can be obtained.

Hereinafter, more specific modes are exemplified. The end portion member was molded from a polyacetal resin with an outside diameter of 28.5 mm, and an effect on the end portion member when the form of the end portion member is changed is considered. Conditions are shown in Table 1. Each item described in Table 1 is as follows.

"Bearing member shape" represents characteristics of the outer peripheral shape of the bearing member, "Twisted triangle" means that the outer shape of a cross-section orthogonal to the direction in which the axis extends is a triangle and the triangle is formed to be twisted in the direction along the axis. "Straight hexagon" means that the outer shape of a cross-section orthogonal to the direction in which the axis extends is a hexagon and the hexagon maintains the same cross-section without being twisted in the direction along the axis. "Tapered hexagon" means that the outer shape of a cross-section orthogonal to the direction in which the axis extends is a hexagon and the edges of the outer shape of the tip end portion thereof are chamfered to form tapered shapes. "Separated tapered hexagon" is the form illustrated in FIGS. 30A and 30B. In addition, "Tapered hexagon" and "Separated tapered hexagon" do not have torsion along the axial direction. In addition, "φ7 cylinder" is an example of the bearing member which is a cylinder with an outside diameter of 7 mm.

"$r_{1g}$" is the radius of the circumscribed circle $D_{og}$ of the bearing member illustrated in FIG. 22.

"$r_{2h}$" is the radius of the inscribed circle $C_{ih}$ of the recessed portion illustrated in FIG. 21.

"$r_{1g}-r_{2h}$" represents the left side of the expression (1).

"Expression (1)" represents whether or not the expression (1) is satisfied, and in a case where the expression (1) is satisfied, "O" is designated, and in a case where the expression (1) is not satisfied, "X" is designated, "Hole diameter" is the diameter of the inner hole of the cylindrical bearing member.

"C surface of hole" means the chamfered portion of the edge portion of the hole at the tip end side of the bearing member as illustrated in FIGS. 31A and 31B, and "00.5" means a chamfered portion with a size of 0.5 mm.

"Height" means the size in the direction along the axis of the bearing member.

"$A_J$" is the cross-sectional area of the recessed portion described above.

"$A_U$" is the cross-sectional area of the bearing member described above.

"Cross-sectional area occupancy ratio" is obtained by the above expression (2).

"Volume" means the volume (V) of a part of the driving shaft inserted into the recessed portion in the bearing member.

"Capacity" means the volume of the recessed portion of the driving shaft. Here, the recessed portion is a hole having a substantially triangular cross-section with a shape twisted in the axial direction as illustrated in FIG. 2A.

"Volume occupancy ratio" is obtained by the above expression (3).

"Undercut" represents presence or absence of the undercut portion in the direction along the axis with respect to the outer peripheral portion of the bearing member. "O" represents absence of the undercut portion, and "X" represents presence of the undercut portion.

Regarding each of the bearing members as described above, the photosensitive drum unit in which the end portion member including the bearing member is attached to the end portion of the photosensitive drum is considered. Moreover, the process cartridge is configured by the photosensitive drum unit, mounting to the apparatus body, operation of the image forming apparatus, and separation of the process cartridge from the apparatus body are performed. Evaluations are performed according to the following criteria.

As Evaluation (A), whether or not the rotational force is reliably transmitted is evaluated. When the rotational force is transmitted, 1 point is given, and when the rotational force cannot be transmitted, 0 points are given.

As Evaluation (B), whether or not reverse rotation is unnecessary during attachment and detachment is evaluated. When the reverse rotation is unnecessary, 1 point is given, and when the reverse rotation is necessary, 0 points are given.

As Evaluation (C), productivity of the end portion member is evaluated. When the productivity is high, 1 point is given, and when the productivity is low, 0 points are given.

As Evaluation (D), strength of a member is evaluated. When sufficient strength is shown, 2 points are given, when a predetermined safety factor is shown, 1 point is given, and strength is insufficient, 0 points are given.

As Evaluation (E), whether or not attachment and detachment is smooth is evaluated. When attachment and detachment is sufficiently smooth, 2 points are given, when the minimum smoothness can be ensured, 1 point is given, and when smooth attachment and detachment cannot be achieved, 0 points are given.

For Evaluations (A) to (E), the grades are applied to the following expression (4).

$$\text{Score}=(A)\times(E)\times[(B)+(C)+(D)] \quad (4)$$

In addition, Score≥7 is designated as "A", 5≤Score≤6 is designated as "B", 3≤Score≤4 designated as "C", Score≤2 is designated as "D" for overall evaluation. The results are shown in Table 2.

TABLE 1

| | Shape of bearing member | $r_{1g}$ (mm) | $r_{2h}$ (mm) | $r_{1g}-r_{2h}$ (mm) | Expression (1) | Hole diameter (mm) | C surface of hole | Height (mm) | $A_J$ ($mm^2$) | $A_u$ ($mm^2$) | Cross-sectional area occupancy ratio | Volume ($mm^3$) | Capacity ($mm^3$) | Volume occupancy ratio | Presence or absence of undercut |
|---|---|---|---|---|---|---|---|---|---|---|---|---|---|---|---|
| No. 1 | Twisted triangle | — | 7.00 | — | — | 3.5 | C0.5 | 3.2 | 61.14 | 34.43 | 56.3% | 108.7 | 187.6 | 57.9% | x |
| No. 2 | Straight hexagon | 8.64 | 7.00 | 1.64 | ○ | 2.0 | None | 3.2 | 61.14 | 31.55 | 51.6% | 101.0 | 187.6 | 53.8% | ○ |
| No. 3 | Straight hexagon | 8.64 | 7.00 | 1.64 | ○ | 3.5 | None | 3.2 | 61.14 | 25.07 | 41.0% | 80.2 | 187.6 | 42.8% | ○ |
| No. 4 | Straight hexagon | 8.64 | 7.00 | 1.64 | ○ | 4.5 | None | 3.2 | 61.14 | 18.79 | 30.7% | 60.1 | 187.6 | 32.1% | ○ |

TABLE 1-continued

| | Shape of bearing member | $r_{1g}$ (mm) | $r_{2h}$ (mm) | $r_{1g} - r_{2h}$ (mm) | Expression (1) | Hole diameter (mm) | C surface of hole | Height (mm) | $A_J$ ($mm^2$) | $A_u$ ($mm^2$) | Cross-sectional area occupancy ratio | Volume ($mm^3$) | Capacity ($mm^3$) | Volume occupancy ratio | Presence or absence of undercut |
|---|---|---|---|---|---|---|---|---|---|---|---|---|---|---|---|
| No. 5 | Straight hexagon | 8.64 | 7.00 | 1.64 | ○ | 5.0 | None | 3.2 | 61.14 | 15.06 | 24.6% | 48.2 | 187.6 | 25.7% | ○ |
| No. 6 | Straight hexagon | 8.64 | 7.00 | 1.64 | ○ | 6.0 | None | 3.2 | 61.14 | 6.42 | 10.5% | 20.5 | 187.6 | 10.9% | ○ |
| No. 7 | Straight hexagon | 9.36 | 7.00 | 2.36 | ○ | 3.5 | C0.5 | 3.2 | 61.14 | 24.81 | 40.6% | 79.4 | 187.6 | 42.3% | ○ |
| No. 8 | Straight hexagon | 10.9 | 7.00 | 3.90 | ○ | 2.0 | None | 3.2 | 61.14 | 47.14 | 77.1% | 150.8 | 187.6 | 80.4% | ○ |
| No. 9 | Straight hexagon | 10.9 | 7.00 | 3.90 | ○ | 2.0 | C0.5 | 3.2 | 61.14 | 47.14 | 77.1% | 149.9 | 187.6 | 79.9% | ○ |
| No. 10 | Straight hexagon | 9.36 | 7.00 | 2.36 | ○ | 6.0 | None | 3.2 | 61.14 | 22.00 | 36.0% | 70.4 | 187.6 | 37.5% | ○ |
| No. 11 | Straight hexagon | 9.36 | 7.00 | 2.36 | ○ | 7.0 | None | 3.2 | 61.14 | 11.79 | 19.3% | 37.7 | 187.6 | 20.1% | ○ |
| No. 12 | Tapered hexagon | 11.1 | 7.00 | 4.10 | ○ | — | C0.5 | 3.2 | 61.14 | 41.76 | 68.3% | 126.1 | 187.6 | 67.2% | ○ |
| No. 13 | Modified tapered hexagon | 11.6 | 7.00 | 4.60 | ○ | 2.0 | None | 3.2 | 61.14 | 58.00 | 94.9% | 165.7 | 187.6 | 88.3% | ○ |
| No. 14 | Separated tapered hexagon | 11.1 | 7.00 | 4.10 | ○ | — | None | 3.2 | 61.14 | 29.69 | 48.6% | 89.0 | 187.6 | 47.4% | ○ |
| No. 15 | φ7 cylinder | 7.00 | 7.00 | 0.00 | — | 2.0 | — | 3.2 | 61.14 | 38.48 | 62.9% | 113.1 | 187.6 | 60.3% | ○ |

TABLE 2

| | Cross-sectional area occupancy ratio | Volume occupancy ratio | (A) | (B) | (C) | (D) | (E) | Grade | Overall evaluation |
|---|---|---|---|---|---|---|---|---|---|
| No. 1 | 56.3% | 57.9% | 1 | 0 | 0 | 2 | 1 | 2 | D |
| No. 2 | 51.6% | 53.8% | 1 | 1 | 1 | 2 | 2 | 8 | A |
| No. 3 | 41.0% | 42.8% | 1 | 1 | 1 | 2 | 2 | 8 | A |
| No. 4 | 30.7% | 32.1% | 1 | 1 | 1 | 2 | 2 | 8 | A |
| No. 5 | 24.6% | 25.7% | 1 | 1 | 1 | 1 | 2 | 6 | B |
| No. 6 | 10.5% | 10.9% | 1 | 1 | 1 | 0 | 2 | 4 | C |
| No. 7 | 40.6% | 42.3% | 1 | 1 | 1 | 2 | 2 | 8 | A |
| No. 8 | 77.1% | 80.4% | 1 | 1 | 1 | 2 | 1 | 4 | C |
| No. 9 | 77.1% | 79.9% | 1 | 1 | 1 | 2 | 1 | 4 | C |
| No. 10 | 36.0% | 37.5% | 1 | 1 | 1 | 2 | 2 | 8 | A |
| No. 11 | 19.3% | 20.1% | 1 | 1 | 1 | 1 | 2 | 6 | B |
| No. 12 | 68.3% | 67.2% | 1 | 1 | 1 | 2 | 2 | 8 | A |
| No. 13 | 94.9% | 88.3% | 1 | 1 | 1 | 2 | 1 | 4 | C |
| No. 14 | 48.6% | 47.4% | 1 | 1 | 1 | 2 | 2 | 8 | A |
| No. 15 | 62.9% | 60.3% | 0 | 1 | 1 | 2 | 2 | 0 | D |

No. 1 is the bearing member having the twisted shape, and during separation thereof, reverse rotation is needed, and thus smooth separation cannot be achieved. On the other hand, in No. 15, the driving shaft and the bearing member are not engaged with each other in the rotational direction, and thus the rotational force cannot be transmitted.

In addition, in other examples, when the cross-sectional area occupancy ratio is in a range of 15% to 75%, the grade is 5 points or higher, and thus the overall evaluation is graded "B" or higher. Moreover, when the cross-sectional area occupancy ratio is 20% or higher, in any of Evaluations D and E, 2 points are given, and thus the evaluation is "A".

On the other hand, in examples other than Nos. 1 and 15, focusing on the volume occupancy ratio, when the volume occupancy ratio is in a range of 20% to 70%, the grade is 5 points or higher, and thus the overall evaluation is graded "B" or higher. Moreover, when the volume occupancy ratio is 30% or higher, in any of Evaluations D and E, 2 points are given, and thus the evaluation is "A".

As described above, according to the second embodiment, the rotational driving force is sufficiently transmitted to the photosensitive drum from the apparatus body, attachment and detachment between the apparatus body and the photosensitive drum unit is smoothly performed, and the productivity of the end portion member is excellent.

REFERENCE SIGNS LIST

1 image forming apparatus
2 image forming apparatus body
3 process cartridge
10 photosensitive drum unit
11 photosensitive drum
20 end portion member
30 bearing member
51 driving shaft
52 recessed portion

The invention claimed is:

1. An end portion member which is disposed at an end portion of a photosensitive drum unit that is detachably mounted to an image forming apparatus body which includes a driving shaft having a recessed portion which is a twisted hole with a substantially triangular cross-sectional shape, comprising:

a cylindrical or columnar bearing member that engages with and separates from the recessed portion, wherein the bearing member has no undercut portion on an outer peripheral surface in a direction along an axis, and while the bearing member is in an attitude of being engaged into the recessed portion, at any part where the bearing member comes into contact with the recessed portion, a cross-sectional area occupancy ratio, which is a degree of area occupied by a cross-section of the bearing member with respect to a cross-section of the recessed portion in a cross-section orthogonal to a direction in which the axis extends, is 15% or higher and 75% or less, and an outer peripheral shape of the bearing member in a cross-section orthogonal to the direction in which the axis extends is a hexagon, and a radius of a circumscribed circle of the hexagon of the bearing member is $r_{1g}$, and when a hexagon is formed by sides enclosed by a triangle formed at an opening of the recessed portion when the recessed portion is viewed from a front in the axial direction and a triangle formed at a bottom of the recessed portion, a radius of an inscribed circle of the hexagon of the recessed portion is $r_{2h}$, $$r_{1g}-r_{2h}>0.$$

2. The end portion member according to claim 1, wherein the cross-sectional area occupancy ratio is 20% or higher and 70% or less.

3. The end portion member according to claim 1, wherein, regarding the bearing member, while the bearing member is in the attitude of being engaged into the recessed portion, a volume occupancy ratio which is a degree of volume occupied by the bearing member with respect to a capacity of the recessed portion is 20% or higher and 70% or less.

4. The end portion member according to claim 1, wherein the bearing member is divided into two or more sections.

5. The end portion member according to claim 1, wherein, in the hexagonal outer peripheral shape of the bearing member, outside a part where a ridge line of the opening of the recessed portion and the bearing member come into contact with each other, the bearing member has a chamfered portion.

6. A photosensitive drum unit comprising:

a cylindrical photosensitive drum; and the end portion member according to claim 1, which is mounted to at least one end portion of the photosensitive drum.

7. A process cartridge comprising:

the photosensitive drum unit according to claim 6;

a charging roll which charges the photosensitive drum of the photosensitive drum unit; and a developing roll which develops an electrostatic latent image onto the photosensitive drum.

8. An end portion member which is disposed at an end portion of a photosensitive drum unit that is detachably mounted to an image forming apparatus body which includes a driving shaft having a recessed portion which is a twisted hole with a substantially triangular cross-sectional shape, comprising:

a cylindrical or columnar bearing member that engages with and separates from the recessed portion, wherein the bearing member has no undercut portion in an axial direction of an outer peripheral surface thereof, and while the bearing member is in an attitude of being engaged into the recessed portion, a volume occupancy ratio which is a degree of volume occupied by the bearing member with respect to a capacity of the recessed portion is 20% or higher and 70% or less, and an outer peripheral shape of the bearing member in a cross-section orthogonal to the axial direction is a hexagon, and a radius of a circumscribed circle of the hexagon of the bearing member is $r_{1g}$, and when a hexagon is formed by sides enclosed by a triangle formed at an opening of the recessed portion when the recessed portion is viewed from a front in the axial direction and a triangle formed at a bottom of the recessed portion, a radius of an inscribed circle of the hexagon of the recessed portion is $r_{2h}$, $$r_{1g}-r_{2h}>0.$$

9. The end portion member according to claim 8, wherein the volume occupancy ratio is 30% or higher and 70% or less.

10. The end portion member according to claim 8, wherein the bearing member is divided into two or more sections.

11. The end portion member according to claim 8, wherein, in the hexagonal outer peripheral shape of the bearing member, outside a part where a ridge line of the opening of the recessed portion and the bearing member come into contact with each other, the bearing member has a chamfered portion.

* * * * *